US008313100B2

(12) United States Patent
Nireki

(10) Patent No.: US 8,313,100 B2
(45) Date of Patent: Nov. 20, 2012

(54) PAPER SHEET PROCESSING APPARATUS WITH REDETECTION PROCESS AND METHOD OF CONVEYING PAPER SHEET

(75) Inventor: Takao Nireki, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 0 days.

(21) Appl. No.: 13/120,761

(22) PCT Filed: Sep. 17, 2009

(86) PCT No.: PCT/JP2009/066289

§ 371 (c)(1),
(2), (4) Date: Mar. 24, 2011

(87) PCT Pub. No.: WO2010/035695

PCT Pub. Date: Apr. 1, 2010

(65) Prior Publication Data

US 2011/0210503 A1 Sep. 1, 2011

(30) Foreign Application Priority Data

Sep. 24, 2008 (JP) ..... 2008-244030

(51) Int. Cl.
*G07F 7/04* (2006.01)

(52) U.S. Cl. ..... 271/265.01; 271/902; 194/203; 194/207; 194/351

(58) Field of Classification Search ..... 271/10.03, 271/265.01, 902; 194/207, 203, 351; 382/135
See application file for complete search history.

(56) References Cited

U.S. PATENT DOCUMENTS 6,105,747 A * 8/2000 Uemizo et al. ..... 194/203
2004/0211644 A1* 10/2004 Liu et al. ..... 194/207

FOREIGN PATENT DOCUMENTS

| | | | |
|---|---|---|---|
| JP | 51 048092 | | 4/1976 |
| JP | 55 081863 | | 6/1980 |
| JP | 55081863 | A * | 6/1980 |
| JP | 01 172169 | | 12/1989 |
| JP | 05105283 | A * | 4/1993 |
| JP | 10 269400 | | 10/1998 |
| JP | 2008 120491 | | 5/2008 |

OTHER PUBLICATIONS

International Search Report issued Dec. 15, 2009 in PCT/JP09/066289 filed Sep. 17, 2009.

* cited by examiner

*Primary Examiner* — Jeremy R Severson
(74) *Attorney, Agent, or Firm* — Lexyoume IP Meister, PLLC.

(57) ABSTRACT

A paper sheet or bill processing apparatus capable of reliably detecting a paper sheet or bill present in a traveling route. The paper sheet or bill processing apparatus includes: a motor for a paper sheet or bill conveyance mechanism which can be driven to convey a paper sheet or bill along a traveling route; a discharge sensor which detects whether or not the paper sheet or bill is present in the traveling route; and control means which carries out a redetection process to detect whether or not the paper sheet or bill is present in the traveling route again by the discharge sensor after the motor is driven if the paper sheet or bill is not detected by the discharge detection sensor in a detection process in a condition that driving of the conveyance mechanism is stopped.

4 Claims, 15 Drawing Sheets

PAPER SHEET PROCESSING APPARATUS WITH REDETECTION PROCESS AND METHOD OF CONVEYING PAPER SHEET

FIELD OF THE INVENTION

The present invention relates to a paper sheet processing device (or paper sheet processing apparatus) which conveys and processes a bill, a gift certificate, a coupon ticket, and so on (hereafter, these are collectively referred to as a paper sheet).

BACKGROUND ART

In general, a bill processing apparatus, which handles a bill as one of the embodiments of the paper sheet, is incorporated into a service device such as a game medium rental machine installed in a game hall, a vending machine or a ticket-vending machine installed in a public space, or the like which judges the authenticity of the bill inserted from a bill insertion slot by a user and provides various types of products and services in accordance with a value of the bill having been judged as authentic.

Normally, when a user inserts a bill from a bill insertion slot, the bill is conveyed through a traveling route by a conveyance mechanism including a conveyor roller etc. and passes through a reading sensor for reading bill information on the way such that an authenticity judgment process is conducted. Further, a plurality of sensors for detecting a moving bill are arranged in a frame that defines a traveling route through which the bill moves so that the position of the bill inserted from the bill insertion slot can be grasped at all times. For example, Patent Document 1 discloses a paper sheet processing apparatus capable of reliably detecting a paper sheet (bill) left in the traveling route by arranging a plurality of sensors for detecting the paper sheet along the traveling route and by setting the installation intervals between respective sensors in the traveling route direction, the installation interval between a traveling start end and the sensor installed nearest to the traveling start end in the traveling route direction, and the installation interval between a traveling back end and the sensor installed nearest to the traveling back end in the traveling route direction to a length equal to or less than the length of the paper sheet in the traveling direction. Further, Patent Document 1 discloses detecting the presence of the paper sheet in a state where the conveyance of the paper sheet is stopped, by way of example, in a state where the power source is just turned on or in a state where jamming is just cleared.

PRIOR ART DOCUMENTS

Patent Document

[Patent Document 1] Japanese unexamined patent application publication No. 2008-120491

SUMMARY OF THE INVENTION

Problem to be Solved by the Invention

As a raw material of paper of a paper sheet to be inserted into the paper sheet processing apparatus, linen or cotton is generally used, however, there is a country that issues a polymer bill that is made of a transparent synthetic resin instead of conventional paper and is excellent in durability (for example, Hong Kong, etc.). Such a polymer bill may include a transparent portion in which printing is not conducted because of an aesthetic design thereof such that it is possible that the sensor may not be able to detect the bill left in the traveling route, no matter what the installation interval is, if the transparent portion coincides with an installation position of a sensor when the bill stops.

Means to Solve the Problem

In the present invention, a paper sheet processing apparatus may be provided such that the apparatus comprises a conveyance mechanism which is capable of driving a paper sheet to be conveyed along a traveling route, a sensor which detects existence or non-existence of the paper sheet in the traveling route, and a controller which determines whether or not the paper sheet exists in the traveling route by detection of the sensor in a state where the driving by the conveyance mechanism is stopped, and performs a redetection process to determine again whether or not the paper sheet exists in the traveling route by the detection of the sensor after the bill is driven by the conveyance mechanism when the controller determines that no paper sheet exits.

Further features of the present invention, its nature, and various advantages will be more apparent from the accompanying drawings and the following description of the preferred embodiment.

BRIEF DESCRIPTION OF THE DRAWINGS

FIG. 7 is a block diagram showing a configuration of control means which controls driving of driving members such as a bill conveyance mechanism, bill reading means, and the like.

MODE FOR CARRYING OUT THE INVENTION

Hereinafter, an embodiment of the present invention will be described with reference to the drawings. Here, in the following description of the embodiment, a bill processing apparatus which processes a bill will be explained as an example of a paper sheet processing apparatus.

Figure 1:
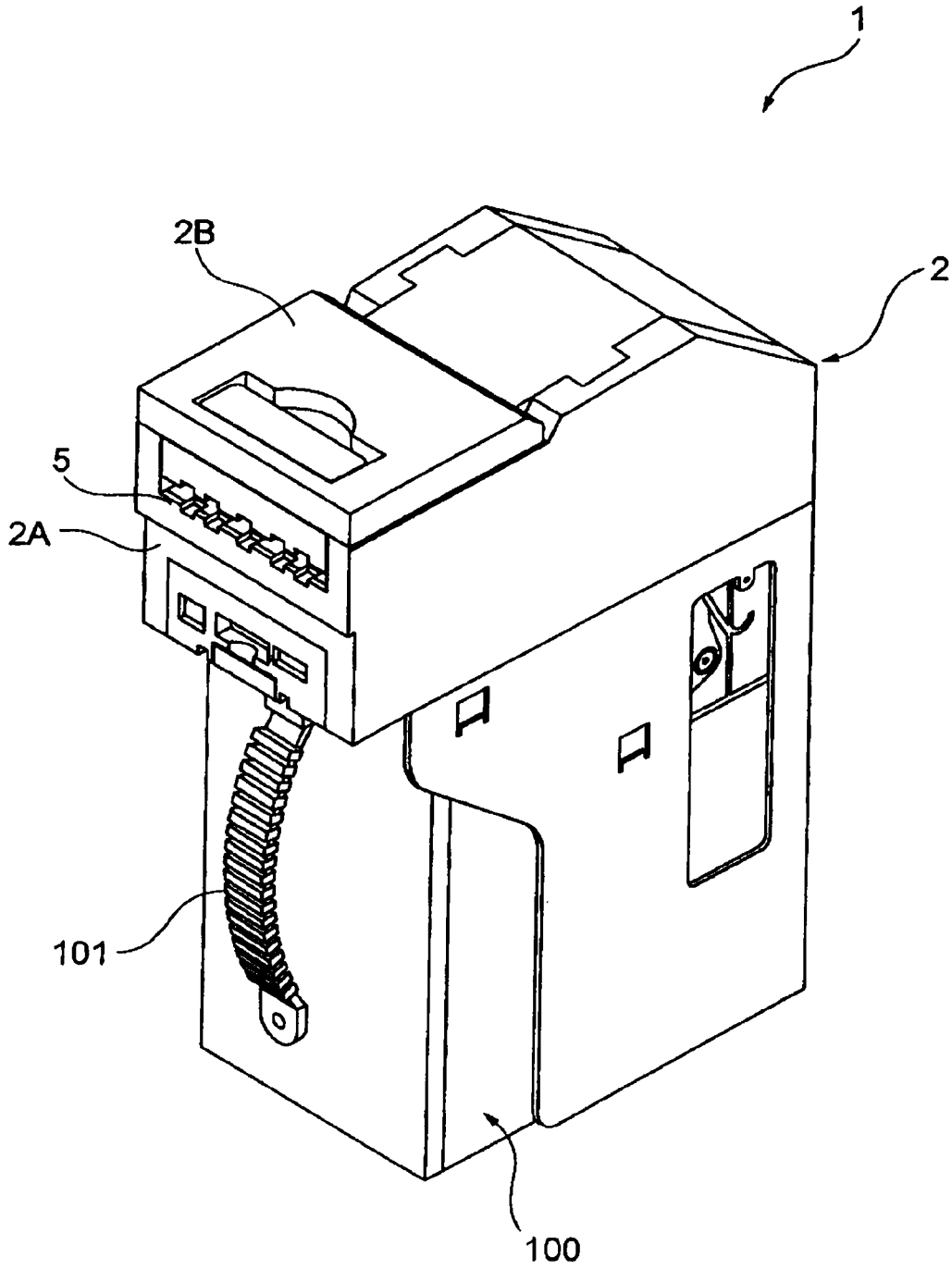
FIG. 1 is a perspective view showing an entire structure to illustrate a configuration of a bill processing apparatus of this embodiment.
Figure 2:
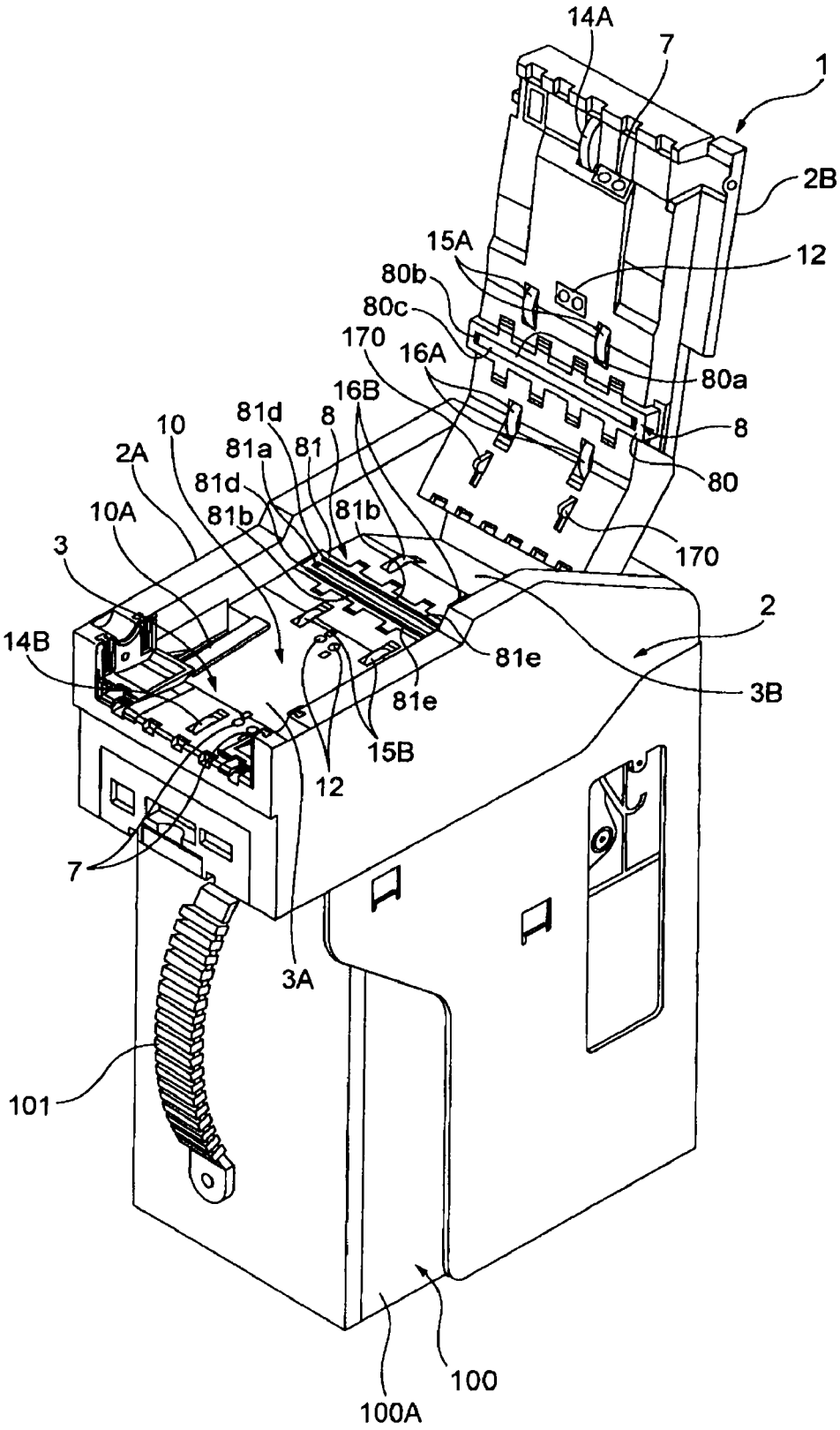
FIG. 2 is a perspective view showing the bill processing apparatus in a state that an open/close member is opened for a main body frame of an apparatus main body.
Figure 3:
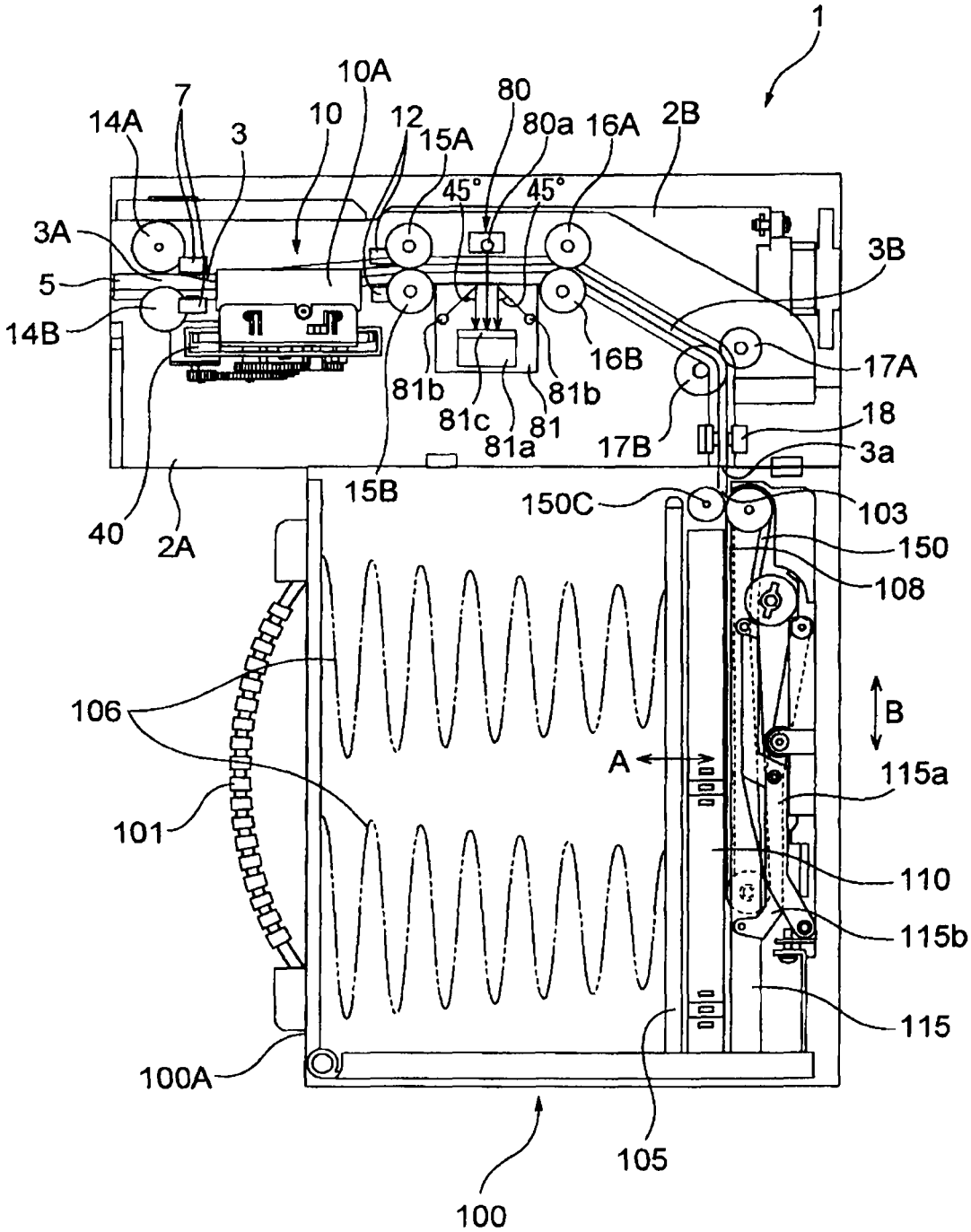
FIG. 3 is a right side view schematically showing a traveling route of a bill to be inserted from an insertion slot.
Figure 4:
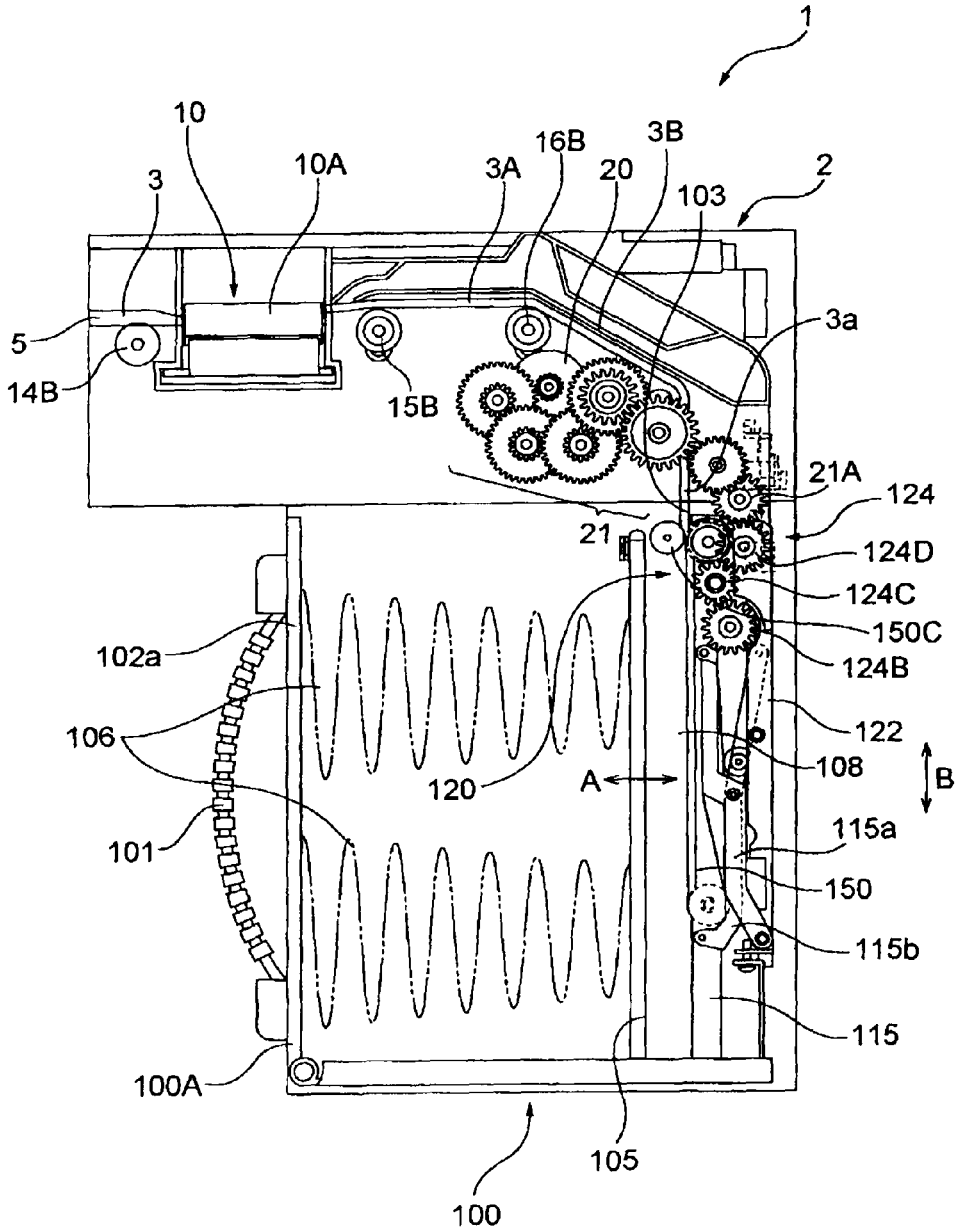
FIG. 4 is a right side view showing a schematic configuration of a power transmission mechanism for driving the presser plate arranged in a bill housing part.
Figure 5:
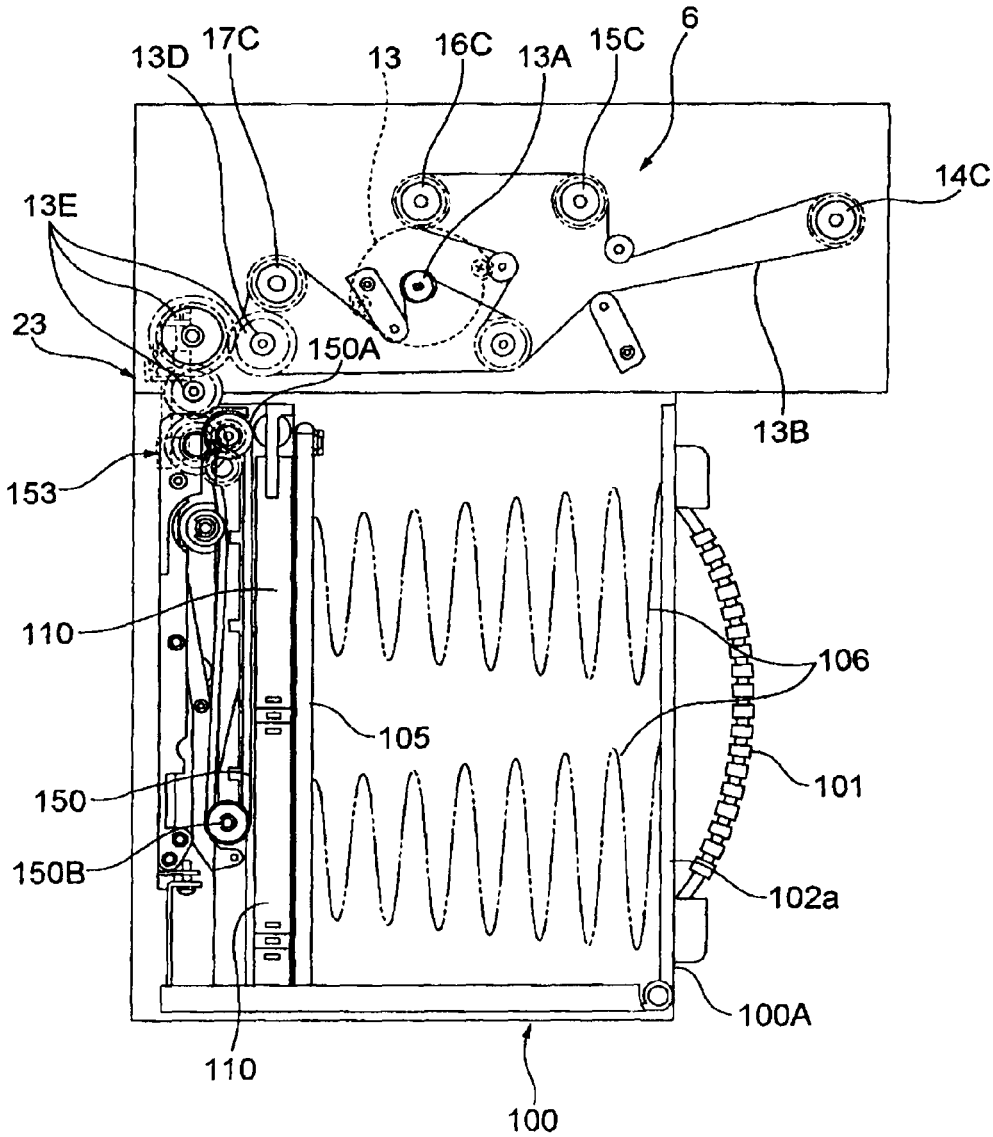
FIG. 5 is a left side view showing a schematic configuration of a driving source and a driving force transmission mechanism to drive a bill conveyance mechanism.

FIGS. 1 to 5 are diagrams showing a configuration of a bill processing apparatus according to this embodiment. FIG. 1 is a perspective view showing a general configuration thereof; FIG. 2 is a perspective view showing a state that an open/close member is opened for a main body frame of an apparatus main body; FIG. 3 is a right side view showing schematically a traveling route for a bill inserted from an insertion slot; FIG. 4 is a right side view showing schematically a power transmission mechanism for driving a presser plate installed in a bill housing part; and FIG. 5 is a left side view showing a schematic configuration of a driving source and a driving force transmission mechanism to drive a bill conveyance mechanism.

A bill processing apparatus 1 of this embodiment is capable of processing a polymer bill having a superior durability in which the above-mentioned material such as transparent synthetic resin is used other than a normal bill made of paper, and can be incorporated into, for example, various types of gaming machines such as a slot machine and the like, and the bill processing apparatus 1 includes an apparatus main body 2 and a housing part (e.g., stacker or cashbox) 100 which is provided to the apparatus main body 2 and is capable of stacking and housing a great number of bills.

Here, the housing part 100 may be mountable to and demountable from the apparatus main body 2, and it is possible, for example, to remove it from the apparatus main body 2 by pulling a handle 101 provided on the front face thereof in a state that a lock mechanism (not shown) is unlocked.

As shown in FIG. 2, the apparatus main body 2 has a main frame body 2A and an open/close member 2B being configured to be opened and closed for the main body frame 2A by rotating around an axis positioned at one end thereof as a rotating center. Then, as shown in FIG. 3, the frame 2A and the open/close member 2B are configured to form a space (bill traveling route 3) through which a bill is conveyed such that both face each other across the space when the open/close member 2B is closed for the main body frame 2A, and to form a bill insertion slot 5 such that front exposed faces of both are aligned and that the bill traveling route 3 exits at the bill insertion slot 5. In addition, the bill insertion slot 5 is a slit-like opening from which a short side of a bill can be inserted into the inside of the apparatus main body 2.

Also, in the apparatus main body 2, a bill conveyance mechanism 6 that conveys a bill along a bill traveling route 3; an insertion detecting sensor 7 that detects the bill inserted into the bill insertion slot 5; bill reading means 8 being a reading unit that is installed on a downstream side of the insertion detecting sensor 7 and reads out information on the bill in a traveling sate; a skew correction mechanism 10 that accurately positions and conveys the bill with respect to the bill reading means 8; a movable piece passage detecting sensor 12 that detects that the bill passes through a pair of movable pieces constituting the skew correction mechanism; and a discharge detecting sensor 18 that detects that the bill is discharged into a bill housing part 100 are provided.

Hereafter, the respective components described above will be described in detail.

The bill traveling route 3 extends from the bill insertion slot 5 toward the inside, and comprises a first traveling route 3A and a second traveling route 3B extending from the first traveling route 3A toward the downstream side and being inclined downwardly at a predetermined angle to the first traveling route 3A. The second traveling route 3B is bent in a vertical direction on the downstream side and a discharge slot 3*a* from which the bill is discharged into the bill housing part 100 is formed at an end portion on the downstream side such that the bill discharged from the discharge slot 3*a* is fed into a feed port (receiving port) 103 of the bill housing part 100 in the vertical direction.

The bill conveyance mechanism 6 is a mechanism capable of conveying the bill inserted from the bill insertion slot 5 along the insertion direction, and of conveying back the bill in an insertion state toward the bill insertion slot 5. The bill conveyance mechanism 6 comprises a motor 13 (e.g., pulse motor; refer to FIG. 5) serving as a driving source installed in the apparatus main body 2; and conveyor roller pairs (14A and 14B), (15A and 15B), (16A and 16B), and (17A and 17B) which are installed with predetermined intervals along the bill traveling direction in the bill traveling route 3, and are driven to rotate by the motor 13.

The conveyor roller pairs are installed so as to be partially exposed on the bill traveling route 3, and all the pairs are constituted of driving rollers of the conveyor rollers 14B, 15B, 16B, and 17B installed on the underside of the bill traveling route 3 and driven by the motor 13; and pinch-rollers of the conveyor rollers 14A, 15A, 16A, and 17A installed on the upperside and driven by the these driving rollers. In addition, the conveyor roller pair (14A and 14B) to first nip and hold therebetween the bill inserted from the bill insertion slot 5, and to convey the bill toward the back side, as shown in FIG. 2, is installed in one portion of the center position of the bill traveling route 3, and a couple of the conveyor roller pairs (15A and 15B), (16A and 16B), or (17A and 17B) being disposed in this order on the downstream side thereof are respectively installed in a couple of portions with a predetermined interval in the lateral direction of the bill traveling route 3.

Further, the conveyor roller pair (14A and 14B) disposed in the vicinity of the bill insertion slot 5 is usually in a state that the upper conveyor roller 14A is spaced from the lower conveyor roller 14B, and the upper conveyor roller 14A is driven to move toward the lower conveyor roller 14B to nip and hold the inserted bill therebetween when insertion of the bill is detected by the insertion detecting sensor 7.

Thus, the upper conveyor roller 14A is controllably driven to be pressed against or spaced from the lower conveyor roller 14B by a motor 70 (refer to FIG. 7) for an up-and-down movement of the roller as a driving source. In this case, when a process (skew correction process) for positioning the bill with respect to the bill reading means 8 by eliminating inclination of the inserted bill is executed by the skew correction mechanism 10, the upper conveyor roller 14A is spaced from the lower conveyor roller 14B so as to release the load on the bill, and when the skew correction process is completed, the upper conveyor roller 14A is driven to move toward the lower conveyor roller 14B again to hold (or nip) the bill therebetween. Here, the driving source may be constituted of a solenoid or the like instead of a motor.

Further, the skew correction mechanism 10 comprises a pair of right and left movable pieces 10A (only one side is shown) such that the pair of right and left movable pieces 10A are moved to get closer with each other by driving a motor 40 for a skew driving mechanism, whereby the skew correction process is performed for the bill.

The conveyor rollers 14B, 15B, 16B, and 17B installed on the underside of the bill traveling route 3 are, as shown in FIG. 5, driven to rotate via the motor 13 and pulleys 14C, 15C, 16C, and 17C installed at the ends of the driving shafts of the respective conveyor rollers. That is, a driving pulley 13A is installed on the output shaft of the motor 13, and a driving belt 13B is wrapped around between the pulleys 14C, 15C, 16C, and 17C installed at the ends of the driving shafts of the respective conveyor rollers and the driving pulley 13A. In addition, tension pulleys are engaged in places with the driving belt 13B, which prevents the driving belt 13B from loosening.

In accordance with the configuration described above, when the motor 13 is driven to normally rotate, the conveyor rollers 14B, 15B, 16B, and 17B are driven to normally rotate in synchronization therewith to convey the bill toward the insertion direction. When the motor 13 is driven to reversely rotate, the conveyor rollers 14B, 15B, 16B, and 17B are driven to reversely rotate in synchronization therewith to convey back the bill toward the bill insertion slot 5 side.

The insertion detecting sensor 7 is to generate a detection signal when a bill inserted into the bill insertion slot 5 is detected. And when the detection signal is generated, the motor 13 is driven in a normal direction and the bill is conveyed in the insertion direction. The insertion detecting sensor 7 of this embodiment is installed between the pair of conveyor rollers (14A and 14B) and the skew correction mechanism 10 and comprises, for example, an optical sensor such as a regressive reflection type photo sensor. However, the insertion detecting sensor 7 may comprise a mechanical sensor other than the optical sensor.

Further, the movable piece passage detecting sensor 12 is to generate a detection signal when it is detected that a leading end of the bill passes through a pair of right and left movable pieces 10A constituting the skew correction mechanism 10, and when the detection signal is generated, the driving by the motor 13 is stopped such that the skew correction is made. The movable piece passage detecting sensor 12 of this embodiment is disposed on the upstream side from the bill reading means 8 and also comprises an optical sensor or a mechanical sensor in the same way as mentioned before with respect to the insertion detecting sensor.

Further, the discharge detecting sensor 18 is to detect a trailing end of the bill passing through such that it is detected that the bill is discharged into the bill housing part 100. The discharge detecting sensor 18 is disposed just in front of the receiving port 103 of the bill housing part 100 on the downstream side of the second traveling route 3B. When the detection signal is transmitted from the discharge detecting sensor 18, the driving by the motor 13 is stopped and the conveyance processing of the bill is terminated. The discharge detecting sensor 18 may also comprise an optical sensor or a mechanical sensor in the same way as the aforementioned insertion detecting sensor.

Here, the discharge detecting sensor 18 has features to detect the bill retained temporarily at a predetermined position (to be referred to as escrow position) when an authenticity judgment process is conducted after bill information is read from the bill having been conveyed, to be described later, by the bill reading means 8.

The bill reading means 8 reads bill information on the bill conveyed in a state that the skew is eliminated by the skew correction mechanism 10, and determines the validity (authenticity). In this embodiment, the bill reading means 8, which is installed in the above-mentioned first traveling route 3A, comprises a line sensor which irradiates the bill being conveyed from top and bottom sides thereof with light such that a transmitted light and a reflected light thereof are detected by a light receiving element so as to perform reading.

And an actual authenticity judgment process is conducted by determining whether or not a feature point in a printed portion match that of the legitimate bill (an area in which the feature points are located and the way to extracting such a feature point can be arbitrarily chosen) as a transmitted light and a reflected light are received by the above-mentioned reading means, for example, when the printed portion of the bill being conveyed is irradiated with light.

In this case, since the legitimate bill has some area from which different image data are acquired depending on the wavelengths of the lights (for example, visible light or infrared light) irradiated to the area, in this embodiment, a plurality of light sources, in consideration of this view point, irradiate different lights of different wavelengths (in this embodiment, a red light and an infrared light are irradiated) to the bill and a transmitted light therethrough and a reflected light thereon are detected such that the authenticity identification accuracy may be improved. That is, since the red light and the infrared light have different wavelengths, transmitted-light data and reflected-light data from a plurality of lights of different wavelengths may be utilized for the bill authenticity judgment whereby the judgment may use the nature that the transmittance of the transmitted light transmitted through the specific area and the reflectance of the reflected light reflected on the specific area in the legitimate bill are different from those of the counterfeit bill. Therefore, an attempt is made to further improve the bill authenticity identification accuracy by employing light sources where a plurality of wavelengths are available.

Here, since it is possible to acquire various kinds of received-light data (e.g., transmitted-light data and reflected-light data) depending on the wavelength of the irradiated light to the bill and the irradiated area of the bill, although a concrete bill authenticity judgment method will not be described in detail, it may be understood that an image in a watermark area of the bill appears greatly different when the image is viewed with the light having a different wavelength. Therefore, it can be considered that the bill to become an identification object is identified as the legitimate bill or the counterfeit bill by setting this portion as the specified area, acquiring transmitted-light data and reflected-light data from the specified area, and comparing such data with legitimate data from the same specified area of the legitimate bill having been stored in advance in storage means (ROM). At this time, provided that specified areas are predetermined according to the kinds of the bills, and that predetermined weighting may be applied to the transmitted-light data and the reflected-light data from this specified area, the authenticity identification accuracy may be improved.

Further, in addition to the above-mentioned authenticity judgment method, after image information on the both surfaces of the bill is acquired as pixel information along the bill traveling direction, for example, with the above-mentioned bill reading means 8, printing lengths on the respective surfaces are derived from the pixel information along the bill traveling direction, such that an authenticity judgment process is performed based on the thus-obtained printing lengths. This authenticity judgment process is configured to eliminate the bill having different printing lengths from those of the legitimate bill because the bill is identified as counterfeit, and it is possible to further improve the identification accuracy of the bill by performing such an authenticity judgment process.

Then, since the above-mentioned bill reading means 8 is, to be described later, configured to perform the lighting control of the light emitting part with a predetermined interval and to comprise the line sensor which detects the transmitted light and the reflected light as the bill passes through, it is possible to acquire the image data based on the plurality of pieces of pixel information in a predetermined size as a unit by the line sensor.

In this case, the image data acquired by the line sensor is converted into data containing color information having luminance for each pixel by a converter which will be described later. In addition, the color information for each pixel having the luminance to be converted by the converter corresponds to a brightness value, and a numerical value from 0 to 255 (0: black to 255: white) is allocated to each pixel, for example, as information of one byte according to the luminance thereof.

Therefore, in the above-mentioned authenticity judgment process, the predetermined area of the bill may be extracted; the pixel information contained in the area and the pixel information in the equivalent area of the legitimate bill may be used so as to be substituted into an appropriate correlating equation; and then a coefficient of correlation may be obtained by carrying out an operation thereof, whereby the authenticity identification may be judged by the coefficient. Or, in addition to the above-described process, analog waveforms, for example, may be generated from the transmitted-light data and the reflected-light data, and the respective shapes of those waveforms may be compared with each other, whereby the authenticity identification may be conducted by such comparison.

Here, the configuration of above-mentioned reading means 8 will be described in detail with reference to FIGS. 2 and 3.

The above-mentioned bill reading means 8 has a light emitting unit 80 which is installed on the side of the open/close member 2B and provided with a first light emitting part 80*a* capable of irradiating the upper side of the bill to be conveyed with the infrared light and the red light; and a light receiving/emitting unit 81 which is installed on the side of the main body frame 2A.

The light receiving/emitting unit 81 has alight receiving part 81*a* which is provided with a light receiving sensor facing the first light emitting part 80*a* across the bill and second light receiving parts 81*b* which are installed adjacently on the both sides of the light receiving part 81*a* along the bill traveling direction and are capable of irradiating the object with the infrared light and the red light.

The first light emitting part 80*a* disposed to face the light receiving part 81*a* works as a light source for the transmissive light. This first light emitting part 80*a* is, as shown in FIG. 2, comprised of a rectangular bar-like body made of synthetic resin which emits the light guided through a light guiding body 80*c* provided inside from an LED element 80*b* fixed to one end of the bar-like body. The first light emitting part configured as described above is arranged in a line in parallel with the light receiving part 81*a* (light receiving sensor) so as to irradiate evenly an entire range in the width direction of the traveling route of the bill to be conveyed with such a simple configuration.

The light receiving part 81*a* of the above-mentioned light receiving/emitting unit 81 extends in a traverse diction with respect to the bill traveling route 3 and is formed in a belt-like shape having a width thereof not to affect the sensitivity of the light receiving sensor (not shown) provided to the light receiving part 81*a*. Here, the light receiving sensor is configured as a so-called line sensor in which a plurality of CCDs (Charge Coupled Devices) are provided linearly in the center in the thickness direction of the light receiving part 81*a*, and a GRIN lens array 81*c* is disposed linearly above these CCDs so as to collect the transmitted light and the reflected light. Therefore, it is possible to receive the transmitted light or the reflected light of the infrared light or the red light emitted from the first light emitting part 80*a* or the second light emitting parts 81*b* such that the bill serving as the object for authenticity judgment is irradiated with the infrared light or the red light, and generate pixel data as received-light data according to its luminance (pixel data containing information of luminance and having a predetermined size as a unit) and a two-dimensional image based on the pixel data.

The second light emitting part 81*b* of the light receiving/emitting unit 81 works as a light source for the reflection light. This second light emitting part 81*b* is, in a similar manner as the first emitting part 80*a*, comprised of a rectangular bar-like body made of synthetic resin which emits evenly to the entire object the light guided through a light guiding body 81*e* provided inside from an LED element 81*d* fixed to one end of the bar-like body. The second light emitting part 81*b* is also configured to be formed in a line and installed in parallel with the light receiving part 81*a* (line sensor).

The second light emitting parts 81*b* are capable of irradiating the bill with the light at an elevation angle of 45 degrees, for example, and are so installed that the light receiving part 81*a* may receive the reflected light from the bill. In this case, the lights irradiated to the bill by the second light emitting parts 81*b* are to be made incident at 45 degrees onto the light receiving part 81*a*, but the incident angle is not limited to 45 degrees such that the arrangement may be re-arranged as appropriate as long as the lights are irradiated evenly without shading to the surface of the bill. Therefore, the arrangement of the second light emitting parts 81*b* and the light receiving part 81*a* may be appropriately changed in design in accordance with the structure of the bill processing apparatus. Further, the second light emitting parts 81*b* are disposed on the both sides of the light receiving part 81*a* so as to be disposed across the light receiving part 81*a* and irradiate the bill with the respective lights at respective incident angles of 45 degrees. This is because, in the case where the surface of the bill has scratches or folded wrinkles, and in the case where the light is irradiated only from one side to an uneven surface generated by these scratches or folded wrinkles, it is unavoidable to make some portions shaded to cause shadow in the uneven surface. Therefore, it is prevented that the shadow is made in the portion of the uneven surface by irradiating the bill with the lights from the both sides, whereby the image data to be acquired can have a higher degree of accuracy than that of the single side irradiation. However, the second light emitting part 81*b* may be installed only on one side to configure the apparatus.

In addition, the configuration, the arrangement, and the like of the light emitting unit 80 and the light receiving/emitting unit 81 as described above are not limited to those described in this embodiment, and may be modified as appropriate.

Figure 6:
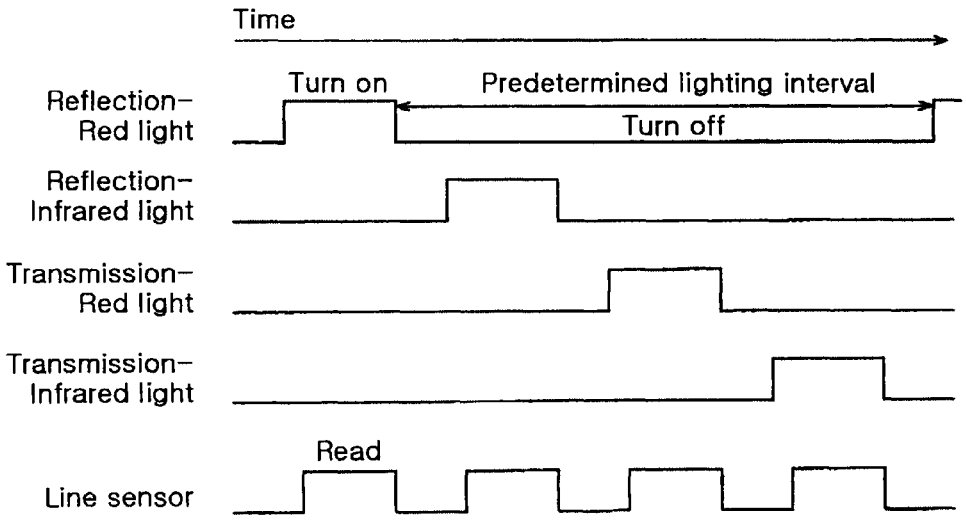
FIG. 6 shows a timing diagram illustrating a lighting control of a light emitting part when the bill is read, which indicates the lighting control of the light emitting part in the bill reading means.

Further, with respect to the first light emitting part 80*a* of the above-mentioned light emitting unit 80 and the second light emitting part 81*b* of the light receiving/emitting unit 81, when the bill is read, as shown in a timing diagram of FIG. 6, an infrared light and a red light are controlled to be turned on and off with predetermined intervals. That is, the lighting control is performed such that the four light sources constituted of the transmitting light sources of the red light and the infrared light and the reflecting light sources of the red light and the infrared light in the first light emitting part 80*a* and the second light emitting parts 81*b* repeatedly turn on and off the lights with a constant interval (predetermined lighting interval), and two or more of the light sources do not simultaneously turn on the lights without overlapping the on-phases of the respective light sources in any case. In other words, lighting control is performed such that, while any one light source is turned on, the other three light sources are turned off. Thereby, as described in this embodiment, it is possible even for the one light receiving part 81*a* to detect each light from each light source at a constant interval such that pixel data containing luminance in the printing area of the bill can be acquired with a transmitted light and a reflected light of the red light, and a transmitted light and a reflected light of the infrared light, and further it is possible to measure the printing lengths of both surfaces. In this case, it is also possible to improve the resolution by controlling the lighting interval to be made shorter.

The bill housing part 100 which houses the above-described bill and the like is so configured as to stack and house sequentially bills identified as genuine by the bill reading means 8.

As shown in FIGS. 3 to 5, the main body frame 100A constituting the bill housing part 100 is formed into a substantially rectangular parallelepiped (or cuboid) shape, and one end of bias means (e.g., bias spring) 106 is attached to an interior side of a front wall 102*a* thereof, and a placing plate 105 on which bills to be fed via the above-described receiving port 103 are sequentially stacked is provided to the other end thereof. Therefore, the placing plate 105 is in a state that it is pressed toward the presser plate 115, which will be described later, by the bias means 106.

In the main body frame 100A, a press standby part 108 that keeps a dropping bill as it falls is provided so as to continuously communicate with the receiving port 103. A pair of regulatory members 110 are disposed on both sides of the press standby part 108, respectively, the regulatory members 110 extending in a vertical direction. An opening is formed between the pair of regulatory members 110 such that the presser plate 115 passes through the opening as bills are successively stacked onto the placing plate 105.

Further, protruding walls are formed on both side walls inside the main body frame 100A such that the placing plate 105 may hit and contact thereon when the placing plate is pressed by the biasing means 106. When the placing plate is biased back by the biasing means 106 after bills are sequentially stacked on the placing plate 105, the protruding walls take a holding role to stably hold the stacked bills by hitting and contacting both sides of a surface of an uppermost bill of the stacked bills.

Further, the presser plate 115 that presses toward the placing plate 105 a bill falling into the press standby part 108 from the receiving port 103 is installed in the main body frame 100A. The presser plate 115 is formed in such a size that it may be capable of reciprocating through an opening formed between the pair of regulatory members 110, and gets into the opening so as to be driven to reciprocate between a position where the bills are pressed against the placing plate 105 (a pressing position) and another position where the press standby part 108 is opened (an initial position). In this case, the bill passes through the opening as being flexibly bent in a pressing operation of the presser plate 115 and is then placed on the placing plate 105.

The presser plate 115 is driven to reciprocate as described above via a presser plate driving mechanism 120 installed in the main body frame 100A. The presser plate driving mechanism 120 comprises a pair of link members 115*a* and 115*b* having respective ends thereof supported pivotally by the presser plate 115 so as to allow the presser plate 115 to reciprocate in an arrow A direction in FIGS. 3 and 4, and these link members 115*a* and 115*b* are connected in a shape of letter "X", and the other ends opposite to the respective ends are supported pivotally by a movable member 122 installed movably in a vertical direction (an arrow B direction). A rack is formed in the movable member 122, and a pinion constituting the presser plate driving mechanism 120 is geared (engaged) with the rack.

As shown in FIG. 4, a housing part side gear train 124 constituting the presser plate driving mechanism 120 is connected to the pinion. For this case, as shown in FIG. 4, in this embodiment, a driving source (a motor 20) and a main body side gear train 21 sequentially engaged with the motor 20 are installed in the above-described apparatus main body 2, and when the bill housing part 100 is mounted to the apparatus main body 2, the main body side gear train 21 is to be connected to the housing part side gear train 124. That is, the housing part side gear train 124 comprises a gear 124B installed on the same axis of the pinion and gears 124C, 124D to be engaged sequentially with the gear 124B, and when the bill housing part 100 is mounted to and demounted from the apparatus main body 2, the gear 124D is configured to be engaged with and disengaged from a final gear 21A of the main body side train 21.

As a result therefrom, the presser plate 115 is driven to reciprocate in the arrow A direction as the motor 20 installed in the apparatus main body 2 is driven to rotate so as to drive the main body side train 21 and in turn the presser plate driving mechanism 120 (the housing part side gear train 124, the rack installed onto the movable member 122, and the link members 115*a*, 115*b*, etc.).

Conveyor members 150 which are capable of touching the bill conveyed-in from the receiving port 103 are installed in the main body frame 100A. The conveyor members 150 take their own role to contact the bill conveyed-in so as to stably guide the bill to an appropriate position in the press standby part 108 (position where the bill can be stably pressed without causing the bill to be moved to the right or left side when the bill is pressed by the presser plate 115). In this embodiment, the conveyor members are constituted of belt-like members (hereafter called belts 150) installed so as to face the press standby part 108.

In this case, the belts 150 are installed so as to extend along the conveying-in direction with respect to the bill, and are wrapped around the pair of pulleys 150A and 150B supported rotatably on both ends in the conveying-in direction. Further, the belts 150 contact a conveyor roller 150C extending in an axis direction which is supported rotatably in the region of the receiving port 103, and the belts 150 and the conveyor roller 150C nip and hold the bill conveyed-in the receiving port 103 therebetween to guide the bill directly to the press standby part 108. Moreover, in this embodiment, the pair of belts 150 are provided on the right and left sides, respectively, across the above-described presser plate 115 in order to be capable of contacting the surface on left and right sides of the bill. Here, the belts 150 may be prevented from loosening by not only being wrapped around the pulleys 150A and 150B at the both ends, but also causing tension pulleys to push the belts 150 at the intermediate positions, respectively.

The pair of belts 150 are configured to be driven by the motor 13 that drives the above-described plurality of conveyor rollers installed in the apparatus main body 2. In detail, as shown in FIG. 5, the above-described driving belt 13B driven by the motor 13 is wrapped around a pulley 13D for the driving force transmission, and a gear train 153 installed at the end of the spindle of the pulley 150A supported rotatably on the receiving port 103 side is engaged with a gear train 13E for the power transmission sequentially installed onto the pulley 13D. That is, when the bill housing part 100 is mounted to the apparatus main body 2, an input gear of the gear train 153 is configured to be engaged with a final gear of the gear train 13E, and the pair of belts 150 are configured to be driven to rotate in a synchronized manner with the above-described conveyor rollers 14B, 15B 16B, and 173 for conveying the bill by driving the motor 13 to rotate.

As described above, when the bill is inserted into the inside via the bill insertion slot 5, the bill is moved inside the bill traveling route 3 by the bill conveyance mechanism 6. As shown in FIG. 3, the bill traveling route 3 has the first traveling route 3A which is extended from the bill insertion slot 5 toward the back side, and the second traveling route 3B which is extended from the first traveling route 3A toward the downstream side and is inclined at a predetermined angle to the first traveling route 3A. A shutter member 170 that prevents the bill from being conveyed toward the bill insertion slot 5 by a fraudulent activity is installed in the second traveling route 3B.

Next, control means 200 that controls the driving of the bill conveyance mechanism 6, the bill reading means 8 and the like as mentioned above will be described with reference to a block diagram of FIG. 7.

Figure 7:
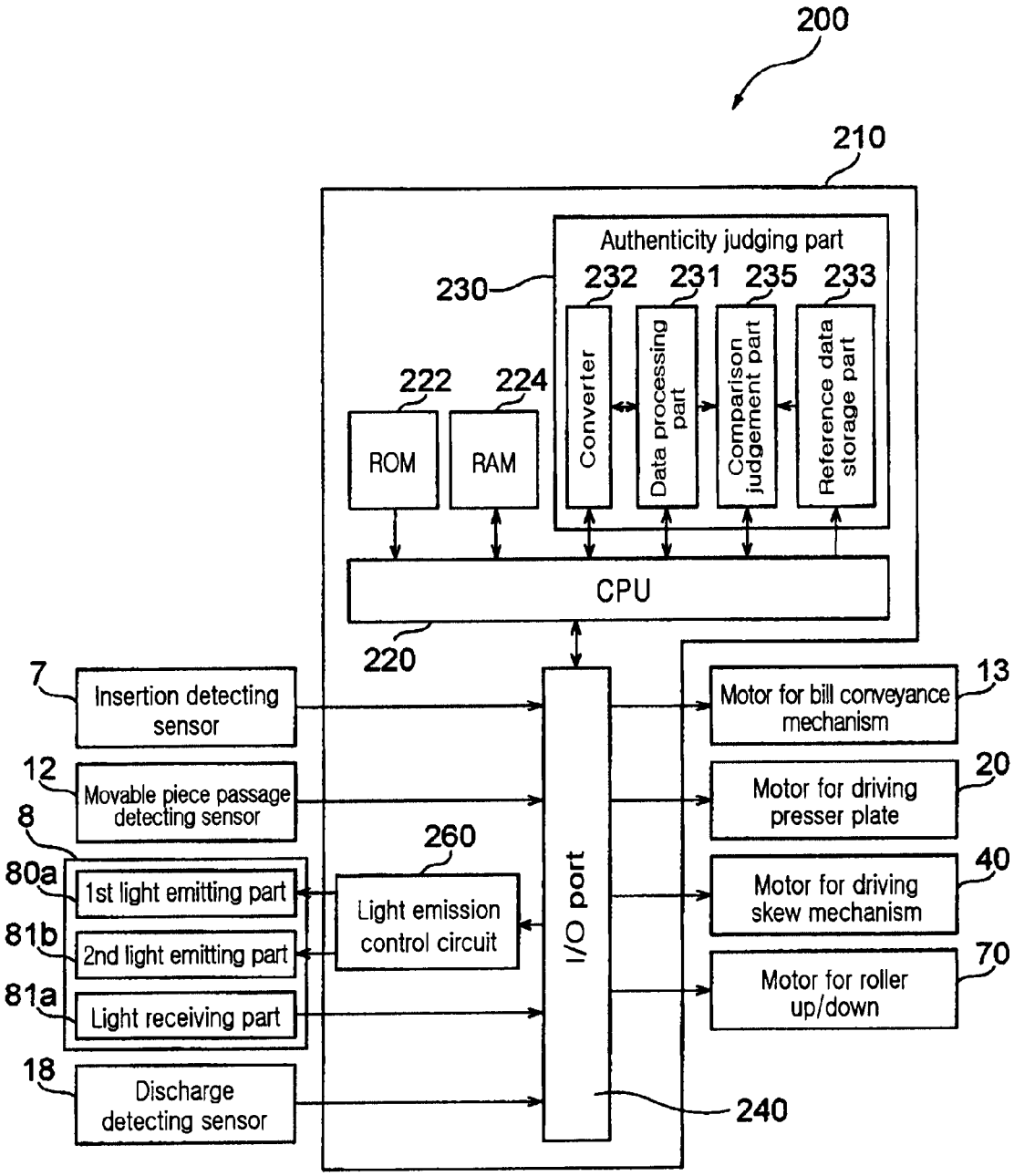
Figure 8:
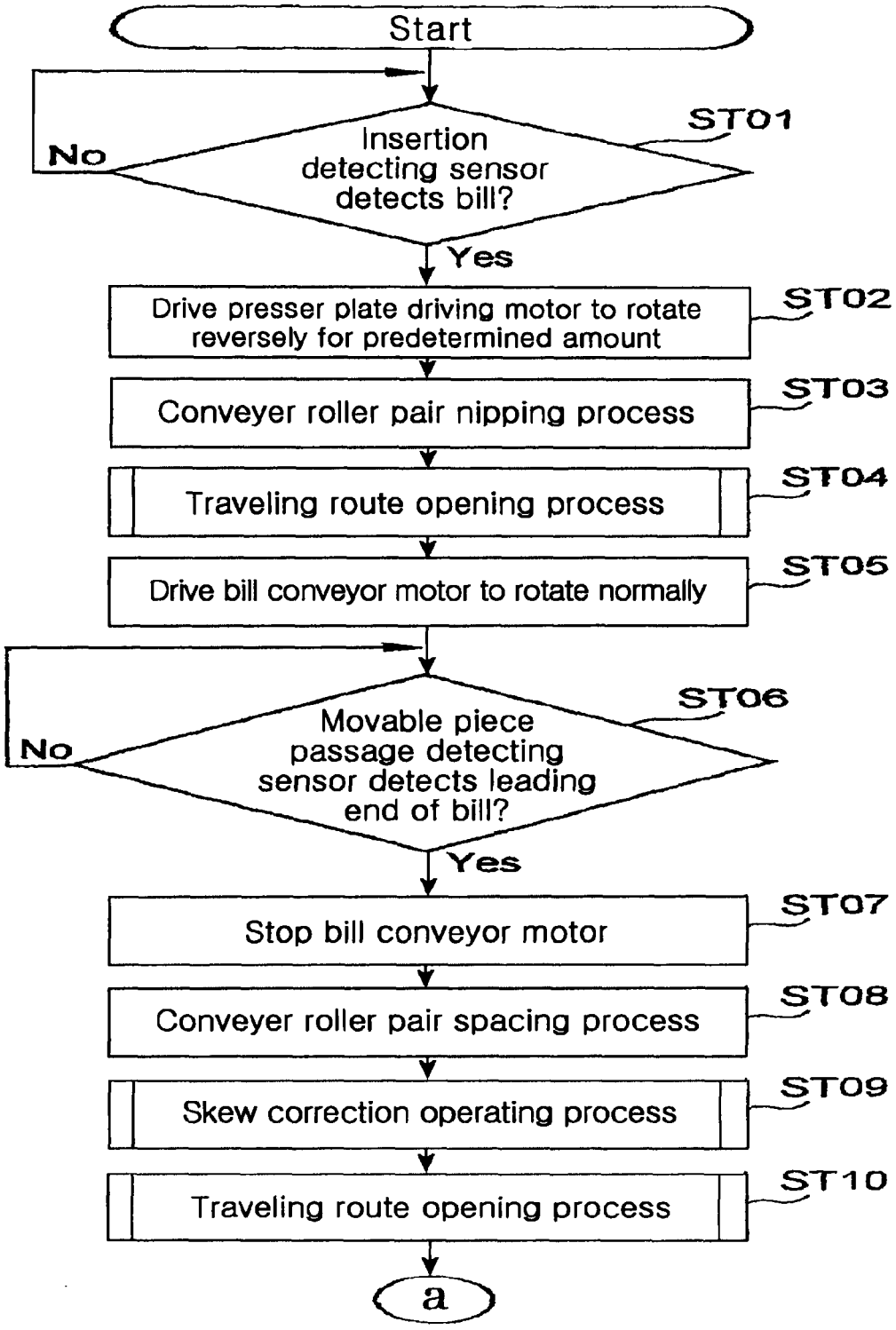
FIG. 8 shows a flowchart (part one) illustrating processing operations for processing the bill in the bill processing apparatus of this embodiment.
Figure 9:
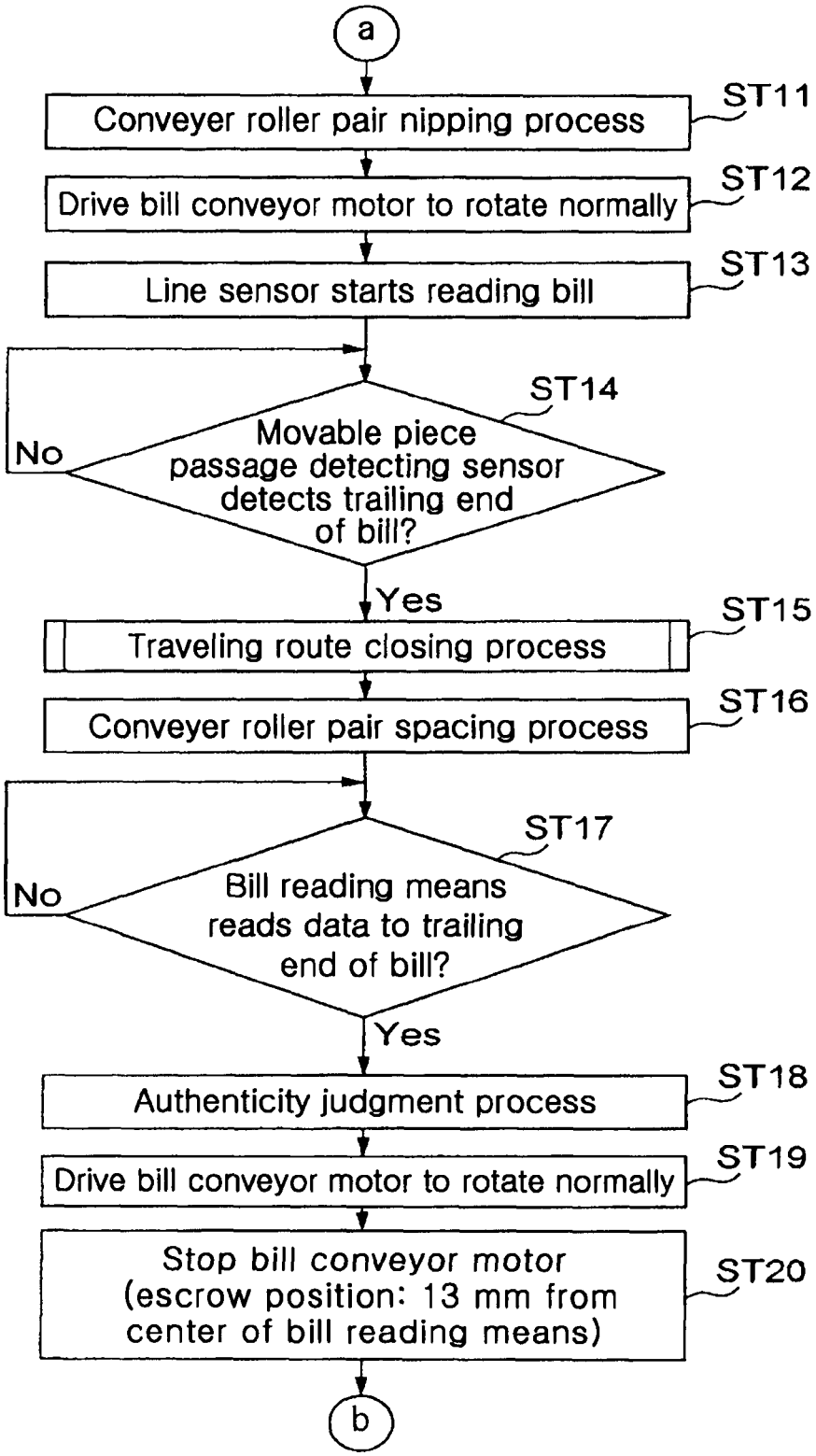
FIG. 9 shows a flowchart (part two) illustrating processing operations for processing the bill in the bill processing apparatus of this embodiment.
Figure 10:
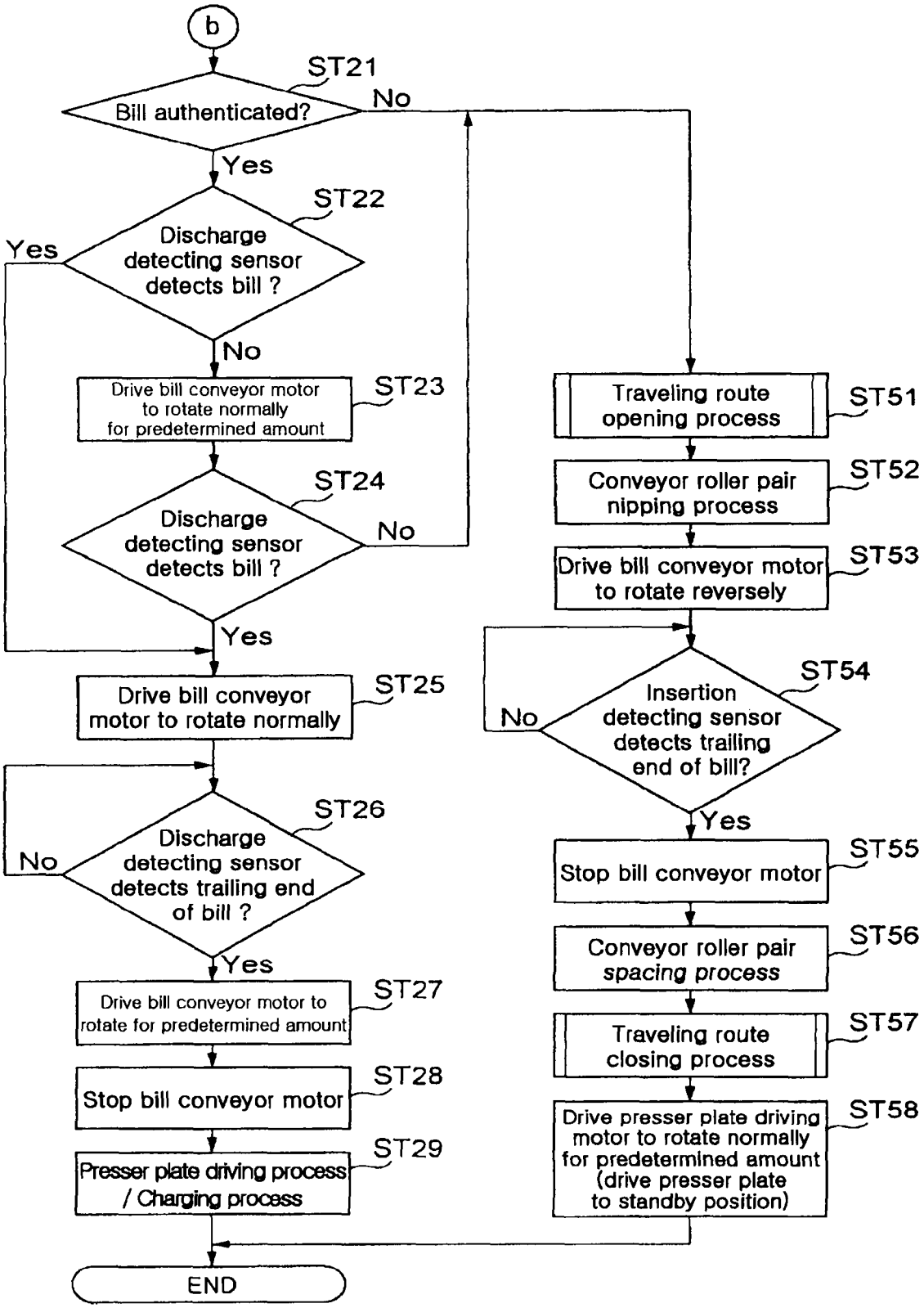
FIG. 10 shows a flowchart (part three) illustrating processing operations for processing the bill in the bill processing apparatus of this embodiment.
Figure 11:
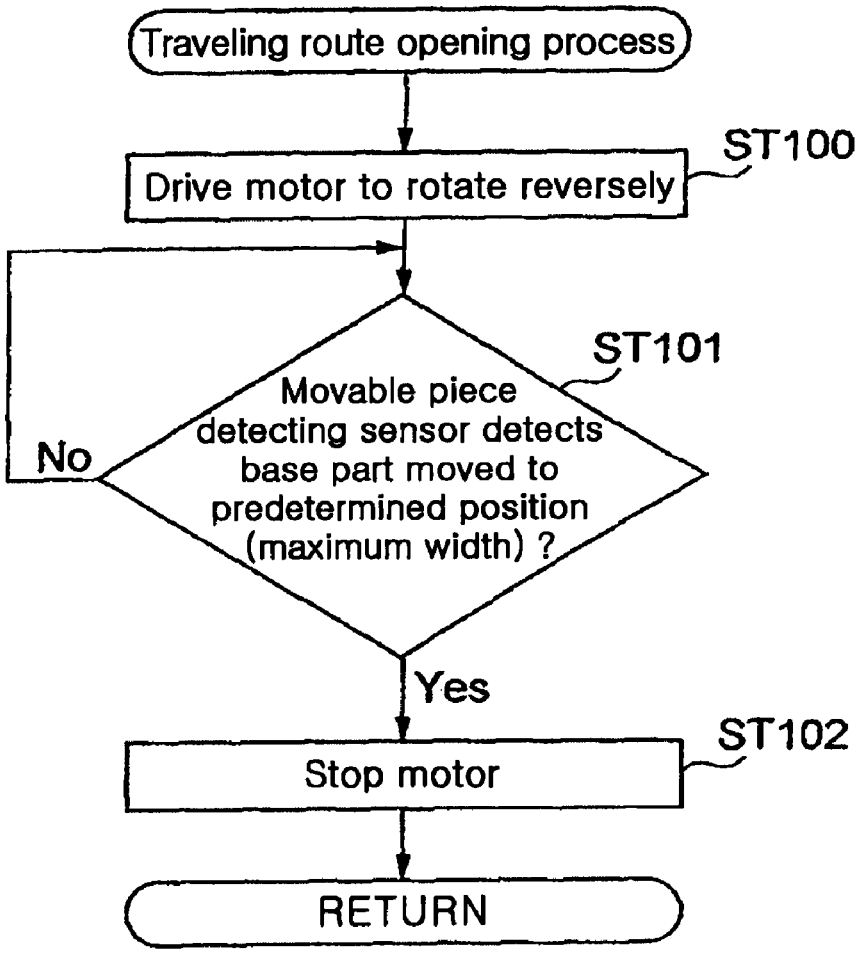
FIG. 11 shows a flowchart (part three) illustrating processing operations for processing the bill in the bill processing apparatus of this embodiment.

The control means 200 as shown in the block diagram of FIG. 7 comprises a control board 210 which controls the operations of the above-described respective drive units, and a CPU (Central Processing Unit) 220 constituting the bill identification means and having a function as a controller to control driving of each drive unit and, a ROM (Read Only Memory) 222, a RAM (Random Access Memory) 224, and an authenticity judging part 230 are implemented on the control board 210.

In the ROM 222, permanent data such as various types of programs such as an authenticity judgment program in the authenticity judging part 230, operation programs for the respective drive units such as the motor 13 for the bill conveyance mechanism, the motor 20 for the presser plate, the motor 40 for the skew correction mechanism, and the roller up-and-down motor 70 for lifting up and down rollers, and the like are stored. Further, the ROM 222 stores a program for a redetection process to detect the presence of the bill by receiving a detection signal from the sensor again, in a case where the presence of the bill cannot be detected by the sensor capable of detecting the presence of the bill. Specifically, in the present embodiment, a program is stored for conducting a detection of the bill again with the discharge detecting sensor 18 after the motor 13 is driven for a predetermined amount (normal rotation) so as to move the bill if the discharge detecting sensor 18 cannot detect the bill (e.g., if the presence of the bill cannot be detected because the ROM 222 cannot receive the detection signal of the bill), while the bill is retained in the escrow position for performing the authenticity judgment process.

By performing such authenticity judgment process, for example, it can be prevented that the bill is erroneously recognized not to exist in the bill traveling route even if the transparent portion is located in the detection position of the discharge detecting sensor 18 in a case where a polymer bill is conveyed and processed as described above. That is, when it is recognized that the bill does not exist with the controller even though the bill actually exists, an erroneous operation such as execution of error processing against an action of drawing out the bill may be performed whereas such error processing can be prevented by performing the above-described redetection process. Further, such an erroneous operation can be prevented for a bill being damaged to have a hole or the like in addition to the bill having the transparent portion such as a polymer bill.

The CPU 220 operates according to the programs stored in the ROM 222, and carries out input and output of the signals with respect to the respective drive units described above via an I/O port 240, so as to perform the entire operational control of the bill processing apparatus. That is, the motor 13 for the bill conveyance mechanism, the motor 20 for the presser plate, the motor 40 for the skew correction mechanism, and the roller up-and-down motor 70 are connected to the CPU 220 via the I/O port 240, and the operations of these drive units are controlled by control signals transmitted from the CPU 220 in accordance with the operation programs stored in the ROM 222.

Further, the CPU 220 is so configured that detection signals from the insertion detecting sensor 7, the movable piece passage detecting sensor 12, and the base part detecting sensor 18 are input into the CPU 220 via the I/O port 240, and the driving of the respective drive units is controlled based on these detection signals. Moreover, the CPU 220 is so configured that a detection signal based on a transmitted light and a reflected light of the light which is irradiated to the identification object is input into the CPU 220 via the I/O port 240 from the light receiving part 81*a* in the bill reading means 8 as described above.

Moreover, the CPU 220 is configured to be connected to the first light emitting part 80*a* and the second light emitting part 81*b* in the aforementioned bill reading means 8 via the I/O port 240. The first light emitting part 80*a* and the second light emitting parts 81*b* are controlled through a light emission control circuit 260 by a control signal from the CPU 220 in accordance with the operation programs stored in the abovementioned ROM 222 such that the lighting interval and the turning-off are controlled.

The RAM 224 temporarily stores data and programs used for the CPU 220 to operate, and also acquires and temporarily stores the received light data (image data constituted of a plurality of pixels) of the bill serving as the identification object.

The authenticity judging part 230 has a function to carry out the authenticity judgment process with respect to the bill to be conveyed so as to identify the authenticity of the bill. The authenticity judging part 230 comprises a converter 232 which converts the received light data of the identification object stored in the RAM 224 into pixel information containing color information having luminance for each pixel, and a data processing part 231 having a function to process image data of the bill acquired from a reflected light and a transmitted light such as processing that printing lengths of the conveyed bill are specified, or the like on the basis of the pixel information converted by the converter 232.

Further, the authenticity judging part 230 has a reference data storage part 233 in which the reference data of the legitimate bill is stored, and a comparison judgment part 235 which compares comparison data, on which various types of data processes of a bill serving as an authenticity identification object are executed in the data processing part 231, with the reference data stored in the reference data storage part 233, so as to perform an authenticity judgment process. In this case, the reference data storage part 233 stores, for example, image data about the legitimate bill to be used, when the above-mentioned authenticity judgment process is carried out, and, in addition thereto, theoretical values of the printing lengths relating to the legitimate bill, for example. In addition, the reference data is stored in the dedicated reference data storage part 233. However, the data may be stored in the above-mentioned ROM 222 or RAM 224.

Next, the bill processing operation in the bill processing apparatus 1 executed by the control means 200 will be described according to the flowcharts of FIGS. 8 to 13.

When an operator inserts a bill into the bill insertion slot 5, the conveyor roller pair (14A and 14B) installed in the vicinity of the bill insertion slot is in a state that the rollers are spaced from each other in an initial stage (refer to ST18 and ST58 to be described later). Further, with respect to the presser plate 115, the pair of link members 115*a* and 115*b* driving the presser plate 115 are located at the press standby part 108, and the presser plate 115 is positioned in the standby position such that the bill cannot be conveyed-in the press standby part 108 from the receiving port 103 by the pair of link members 115*a* and 115*b*. That is, in this state, the presser plate 115 is brought into the opening formed between the pair of regulatory members 110 such that the condition is so made as to prevent the bills stored in the bill housing part from being drawn out through the opening.

Moreover, the pair of movable pieces 10A constituting the skew correction mechanism 10 located on the downstream side of the conveyor roller pair (14A, 14B) are in a state that the pair of movable pieces 10A are moved to leave the minimum open width therebetween (for example, an interval between the pair of movable pieces 10A is 52 mm; refer to ST15 and ST57 to be described later) so as to prevent the bill from being drawn out in the initial stage.

In the initial state of the above-described pair of conveyor rollers (14A and 14B), it is possible for the operator to easily insert even a bill having wrinkles into the paper sheet insertion slot 5. Then, when insertion of the bill is detected by the insertion detecting sensor 7 (ST01), the driving motor 20 of the above-described presser plate 115 is driven to rotate reversely for a predetermined amount (ST02) to move the presser plate 115 to the initial position. That is, the presser plate 115 is in a state that the presser plate 115 is moved and remains in the opening formed between the pair of regulatory members 110 such that it is so arranged that the bill cannot pass through the opening until the insertion of another bill is detected by the insertion detecting sensor 7.

When the presser plate 115 is moved from the standby position to the initial position, the press standby part 108 becomes in an open state (refer to FIG. 4) such that the apparatus is in a state that the bill can be conveyed into the bill housing part 100. When the presser plate 115 is moved from the standby position to the initial position, the press standby part 108 becomes in an open state (refer to FIG. 4) such that the apparatus is in a state that the bill can be conveyed into the bill housing part 100.

Further, the above-described roller up-and-down motor 70 is driven to move the upper conveyor roller 14A so as to make a contact with the lower conveyor roller 14B. In accordance therewith, the inserted bill is nipped and held therebetween by the pair of conveyor rollers (14A and 14B) (ST03).

Next, a traveling route opening process is conducted (ST04). The opening process is conducted by driving the pair of movable pieces 10A to move in separating directions so as to become apart with each other as the motor 40 for the skew correction mechanism is driven to rotate reversely as shown in the flow chart of FIG. 11 (ST100). At this time, when it is detected that the pair of movable pieces 10A have moved to the predetermined positions (the maximum open width positions) by the movable piece detecting sensor (ST101), the driving operation to rotate the motor 40 reversely is stopped (ST102). This traveling route opening process makes the skew correction mechanism in such a condition as to allow the paper sheet to enter between the pair of movable pieces 10A. In addition, in the previous step of ST04, the bill traveling route 3 is in a closed state by a traveling route closing process (ST15, ST57) to be described later. Thus, the bill traveling route 3 is closed in this way before an insertion of the bill so as to prevent an element such as a line sensor from being broken by, for example, inserting a plate-like member from the bill insertion slot for illicit purposes or the like.

Next, the bill conveyor motor 13 is driven to rotate normally (ST05). The bill is conveyed into the inside of the apparatus by the conveyor roller pair (14A and 14B), and when the movable piece passage detecting sensor 12 installed on the downstream side from the skew correction mechanism 10 detects the leading end of the bill, the bill conveyor motor 13 is stopped (ST06 and ST07). At this time, the bill is located between the pair of movable pieces 10A constituting the skew correction mechanism 10.

Subsequently, the above-described roller up-and-down motor 71 is driven to allow the conveyor roller pair (14A and 14B) holding the bill therebetween to become apart from each other (ST08). At this time, the bill is in a state that no load is applied.

Figure 12:
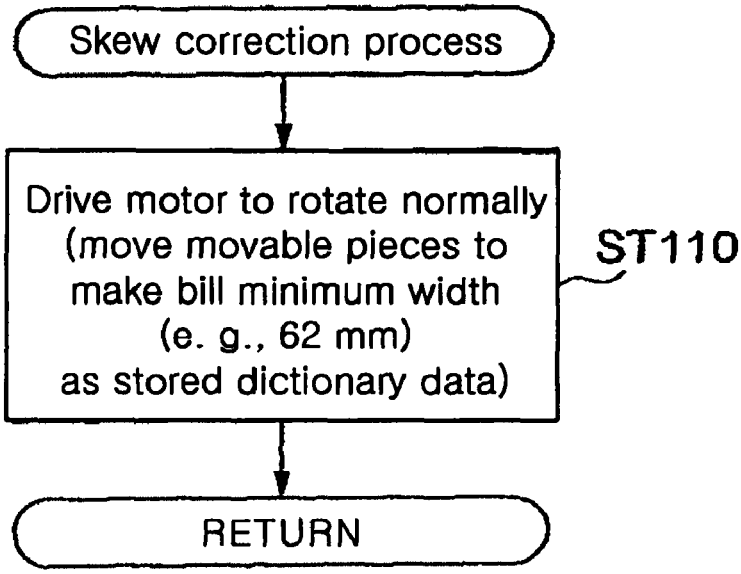
FIG. 12 shows a flowchart illustrating processing operations of a skew correction operating process.

Then, a skew correction operating process is executed as the paper sheet remains in this state (ST09). The skew correction operating process is conducted by driving the motor 40 for the skew correction mechanism to rotate normally to drive the pair of movable pieces 10A to get closer with each other. That is, in this skew correction operating process, as shown in the flowchart of FIG. 12, the motor 40 described above is driven to rotate normally to move the pair of movable pieces 10A in respective directions such that the pair of movable pieces 10A get closer with each other (ST110). The movement of the movable pieces is continued until the distance therebetween becomes the minimum width (for example; width of 62 mm) of the bill registered in the reference data storage part in the control means. And the skew is corrected by the movable pieces 10A touching both sides of the bill such that the bill may be positioned at the accurate center position.

When the skew correction operating process as described above is completed, a traveling route opening process is subsequently executed (ST10). This process is conducted by moving the pair of movable pieces 10A in separating directions as the above-described motor 40 for the skew correction mechanism is driven to rotate reversely (refer to ST100 to ST102 of FIG. 10).

Subsequently, the above-described roller up-and-down motor 70 is driven to move the upper conveyor roller 14A to contact the lower conveyor roller 14B, and the bill is nipped and held between the pair of conveyor rollers (14A and 14B) (ST11). Thereafter, the bill conveyor motor 13 is driven to rotate normally to convey the bill into the inside of the apparatus, and when the bill passes through the bill reading means 8, a reading process of the bill is executed (ST12 and ST13).

In the reading process of the bill, as shown in the timing diagram of FIG. 6, lighting control is performed such that the four light sources constituted of the transmitting light sources of the red light and the infrared light and the reflecting light sources of the red light and the infrared light in the abovementioned first light emitting part 80*a* and the second light emitting parts 81*b* repeatedly turn on and off the lights with a constant interval, and two or more of the light sources do not simultaneously turn on the lights even without overlapping the on-phases of the respective light sources in any case. In other words, lighting control is performed such that, while anyone light source is turned on, the other three light sources are turned off. Thereby, as described in this embodiment, it is possible even for the one light receiving part 81*a* to detect each light from each light source at a constant interval such that an image constituted of contrasting density data on a printing area of the identification object can be read out by a transmitted light and a reflected light of the red light and a transmitted light and a reflected light of the infrared light.

Figure 13:
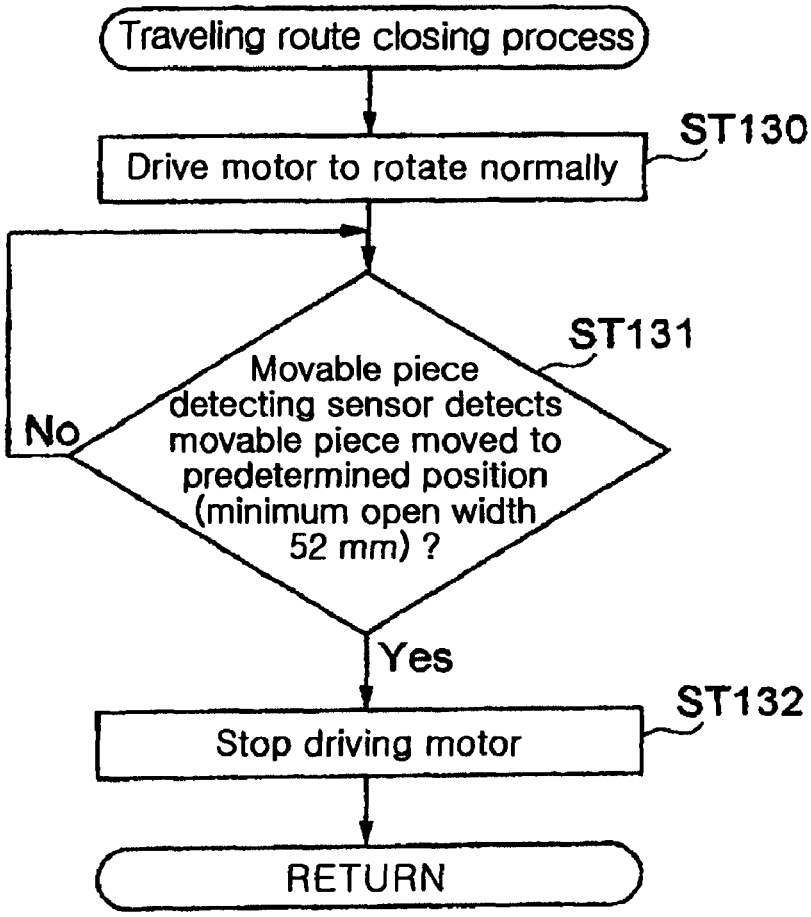
FIG. 13 shows a flowchart illustrating processing operations of a traveling route closing process.

Then, when the bill to be conveyed passes through the bill reading means 8, and the trailing end of the bill is detected by the movable piece detecting sensor 12 (ST14), a process for closing the bill traveling route 3 is executed (ST15). In this process, first, as shown in the flowchart of FIG. 13, after the trailing end of the bill is detected by the movable piece detecting sensor 12, the above-described motor 40 is driven to normally rotate to move the pair of movable pieces 10A in the directions that they get closer to each other (ST130). Next, when it is detected by the movable piece detecting sensor that the movable pieces 10A move to the predetermined positions (minimum open width positions: for example, width of 52 mm) (ST131), the driving operation of the normal rotation of the motor 40 is stopped (ST132).

With this traveling route closing process, the pair of movable pieces 10A are moved to the positions of the minimum open width (width of 52 mm) narrower than the width of any bill allowed to be inserted, thereby effectively preventing the bill from being drawn out. That is, by executing such a bill traveling route closing process, an opening distance between the movable pieces 10A is made shorter than the width of the inserted bill, thereby enabling the effective prevention of an action of drawing-out the bill in the direction toward the insertion slot by the operator for illicit purposes.

In addition, when the movable piece detecting sensor as described above detects the movement of the movable pieces 10A in this state, it may be considered that the operator is committing some fraudulent activities such that a predetermined processes may be executed. For example, a fraudulent manipulated signal (an anomaly sensed signal) may be transmitted to a higher-level apparatus that manages the operations of the bill processing apparatus, or an annunciator lamp may be provided on the bill processing apparatus such that an operation may be carried out to let this lamp blink. Alternatively, the operation of the bill processing apparatus can be cancelled (for example, a process for stopping the processing, a process for discharging the bill, and the like) and other processes may be carried out such that appropriate processing may be executed.

Further, in succession to the traveling route closing process as described above (ST15), a conveyor roller pair spacing process is executed such that the above-mentioned roller up-and-down motor 70 is driven to make the conveyor roller pair (14A, 14B) having been in a state capable of nipping and holding the bill therebetween separate from each other (ST16). By executing the conveyor roller pair spacing process, even if the operator additionally inserts (double insertion) another bill by mistake, the bill is not subject to a feeding operation by the conveyor roller pair (14A, 14B) and hits front ends of the pair of movable pieces 10A in a closed state according to ST15 such that it is possible to reliably prevent the operation of bill double-insertion.

When the bill reading means 8 reads the data up to the trailing end of the bill (ST17) and the bill traveling route closing process is carried out as mentioned above, the reference data stored in a reference data storage part 233 is referred to by an authenticity judging part 230, and then an authenticity judgment process of the bill is executed in accordance with a predetermined authenticity judgment program by the comparison judgment part 233 (ST18). While the authenticity judgment process of the bill is being executed, the motor 13 for the bill conveyance is driven for a predetermined amount having been specified in advance and the bill is stopped at a predetermined position (escrow position; position where the bill is conveyed toward the downstream side by 13 mm from the center position of the bill reading means 8) and retained temporarily (ST19, ST20).

As described above, by temporarily retaining the bill while the authenticity judgment process is executed, a condition in which an operation by the operator is waited for can be secured with respect to the bill having been judged to be legitimate after the authenticity judgment is completed. In another way of saying this, by temporarily retaining the bill when the authenticity judgment process is executed, the bill can be prevented from being conveyed into the bill housing part 100 before the authenticity judgment process is completed.

When the bill is temporarily retained in such an escrow position, the trailing end of the bill is located on the downstream side by 13 mm from the line sensor (center position of the bill reading means), which is the light receiving part 81*a* of the bill reading means as shown in FIG. 3, and a leading end area of the bill is in such a condition that the discharge detecting sensor 18 can detect the leading end area. Here, the CPU 220, which is a controller, is configured to perform the subsequent processing after confirming that the bill exists in the bill traveling route 3 by detecting the detection signal form the discharge detecting sensor 18.

The procedure of the detection process to detect the presence of the bill when the bill is temporarily retained in the escrow position will be described below.

In the authenticity judgment process in ST 18 as described above, when the bill is judged to be the legitimate bill (ST21; Yes), it is subsequently determined whether or not the bill is detected by the discharge detecting sensor 18 (ST 22). At this time, when the bill is detected (ST 22; YES), the process proceeds to processing at ST 25, to be described later, in order to convey the bill to the bill housing part 100 as it is.

In the above-mentioned determination at ST22, in a case where the presence of the bill is not detected (ST22; No), the bill conveyor motor 13 is driven to rotate normally for a predetermined amount (ST23) and then it is determined whether or not the bill is detected by the discharge detecting sensor 18 again (ST24; bill redetection process). In this process, if the bill is detected (ST24; YES), the process of ST25 and subsequent processes therefrom, to be described later, are carried out in order to covey the bill into the bill housing part 100 as it is.

By conveying the bill for the predetermined amount and performing the redetection process of the bill as described above, it is possible to prevent the occurrence of an erroneous operation such as the execution of error processing of drawing out the bill even if the transparent portion is once located at a corresponding position where such a part is subject to the discharge detecting sensor 18 and thus the detection signal cannot be received such that the presence the bill cannot be confirmed when a polymer bill as described above is processed. Further, it is also possible to prevent the occurrence of the erroneous operation in a similar manner even if a damage such as a hole is included in a normal bill, not limited to the polymer bill case.

On the other hand, in the bill redetection process in ST24 as described above, if the bill is not detected (ST24; NO), it is assumed that the bill has not reached the escrow position yet due to jamming etc. or the action of drawing out the bill has been performed actually such that predetermined processing is performed. In this case, according to this embodiment, the process of ST51 and subsequent processes therefrom (processes for discharging the bill), to be described later, are performed to restore the entire apparatus to its initial condition such that the apparatus may be in a condition where a bill can be accepted again.

In the process of ST22 or the process of ST24, if the bill is detected by the discharge detecting sensor 18, the bill conveyor motor 13 is subsequently driven to rotate normally such that the bill is conveyed toward the bill housing part 100 (ST25) as it is.

When the bill is conveyed in the process of ST25, the bill conveyor motor 13 is driven to rotate normally until the trailing end of the bill is detected by the discharge detecting sensor 18 (ST26; Yes), and after the trailing end of the bill is detected by the discharge detecting sensor 18, the bill conveyor motor 13 is further driven to rotate normally for a predetermined amount (ST27 and ST28).

The process for driving the bill conveyor motor 13 to rotate normally in ST27 and ST28 corresponds to a driving amount for which the bill is conveyed into the receiving port 103 of the bill housing part 100 from the discharge slot 3*a* on the downstream side of the bill traveling route 3 of the apparatus main body 2 so that the pair of belts 150 contact the surface on both sides of the conveyed-in bill to guide it stably to the press standby part 108. That is, by further driving the bill conveyor motor 13 to rotate normally for a predetermined amount after the trailing end of the bill is detected by the discharge detecting sensor 18, the pair of belts 150 contact the bill conveyed-in, which is driven in the feeding direction, so as to guide the bill in a stable state to the press standby part 108.

Then, after the above-described bill conveyor motor 13 is stopped, the process for driving the presser plate 115 is executed (ST29) such that the bill is placed on the placing plate 105. The driving process of the presser plate 115 is performed by having the presser plate press the bill such that the bill is placed onto the placing plate 105 and by moving the presser plate 115 back to the standby position again where the presser plate 115 is stopped when the housing operation is completed. In performing the driving process of the presser plate 115 in ST29, the charging process of the conveyed bill is also performed at a stage where detecting means (not shown) detects movement of the placing plate 105 as the detecting means is configured to detect the movement of the placing plate 105. This charging process is performed by transmitting specific value information of the bill having been read by the bill reading means 8 to a higher-level apparatus of a slot machine or the like.

In ST21 of the above-mentioned processing procedure, when a bill having been inserted is identified not to be the legitimate bill, processing to discharge the bill and restore the apparatus into its initial condition (condition where a bill can be accepted) is performed. Concretely, a traveling route opening process is executed (refer to ST51, and ST100 to ST102 of FIG. 11) and then the bill conveyor motor 13 is driven to rotate reversely and the conveyor roller pair (14A, 14B) are brought in contact with each other such that the bill staying in the escrow position is conveyed toward the bill insertion slot 5 (ST52 and ST53). Here, the bill conveyor motor 13 may be controlled such that the conveyance speed of the bill is enhanced in the conveyor processing (discharge process).

Then, when the insertion detecting sensor 7 detects the trailing end of the bill to be returned toward the bill insertion slot 5, the driving to reversely rotate the bill conveyor motor 13 is stopped, and above-described roller up-and-down motor 70 is driven to make the conveyor roller pair (14A and 143) in a state of nipping and holding the bill therebetween separate from each other (ST54 to ST56). After that, the traveling route closing process is executed (refer to ST57, and ST130 to ST132 in FIG. 13) and the driving motor 20 for the presser plate 115 is driven to rotate normally (ST58) such that the presser plate 115 positioned at the initial position is driven to move to the standby position, and then a series of processes are completed. Here, the insertion detecting sensor 7 may be configured to execute predetermined error processing by assuming jamming or the like has occurred inside unless the insertion detecting sensor 7 detects finally the bill to be discharged.

In the bill redetection process in ST24 as described above, when the presence of the bill is not detected (ST24; NO), the bill discharge process as described above (ST51 to ST58) is performed, and, even if an action of drawing out the bill has been conducted, it is unlikely that a damage or the like is incurred by such a fraudulent activity since the charging process in ST29 as described above has not been performed. As a matter of course, it may also be possible to transmit a warning signal to an external device, such as a host computer and notification device or to perform the stopping process of the bill apparatus itself in addition to the bill discharge process as described above.

According to the bill processing apparatus 1 with the above-described configuration, even if the presence of the bill cannot be confirmed because the bill includes a portion through which light may be transmitted, such as a water-marked portion of a polymer bill and a hole of a normal bill, in a detection position of the bill being subject to the detection by the discharge detecting sensor 18, the presence of the bill can be detected reliably since the redetection process is performed after the bill is moved to a position where the bill can be detected. As a result, it is possible to prevent an erroneous operation of the apparatus, such as the execution of error processing of drawing out the bill, more reliably.

In the embodiment described above, the paper sheet processing apparatus is configured to confirm the presence of the paper sheet by the sensor again after driving the conveyance mechanism if the presence of the paper sheet is not confirmed previously by the sensor that is configured to detect the paper sheet existing in the traveling route as the paper sheet is detected in the state of being stopped in the traveling route. Hence, even if the sensor cannot confirm the presence of the paper sheet because the paper sheet includes a transparent portion etc., the paper sheet is moved to a position where the paper sheet can be detected and the redetection process is performed again, thereby enabling detection of the presence of the paper sheet more reliably.

Further, the paper sheet processing apparatus comprises the authenticity judging part that judges the authenticity of the paper sheet conveyed in the traveling route and after the authenticity judgment by the authenticity judging part, it is possible to perform the redetection process by the controller for the paper sheet temporarily held in the traveling route when the driving of the conveyance mechanism is stopped.

According to the paper sheet processing apparatus with the configuration as described above, it is possible to more reliably prevent an erroneous operation to cause the error of drawing out the paper sheet even though the paper sheet is actually existing and retained temporarily in the traveling route at the time of the authenticity judgment process.

Figure 14:
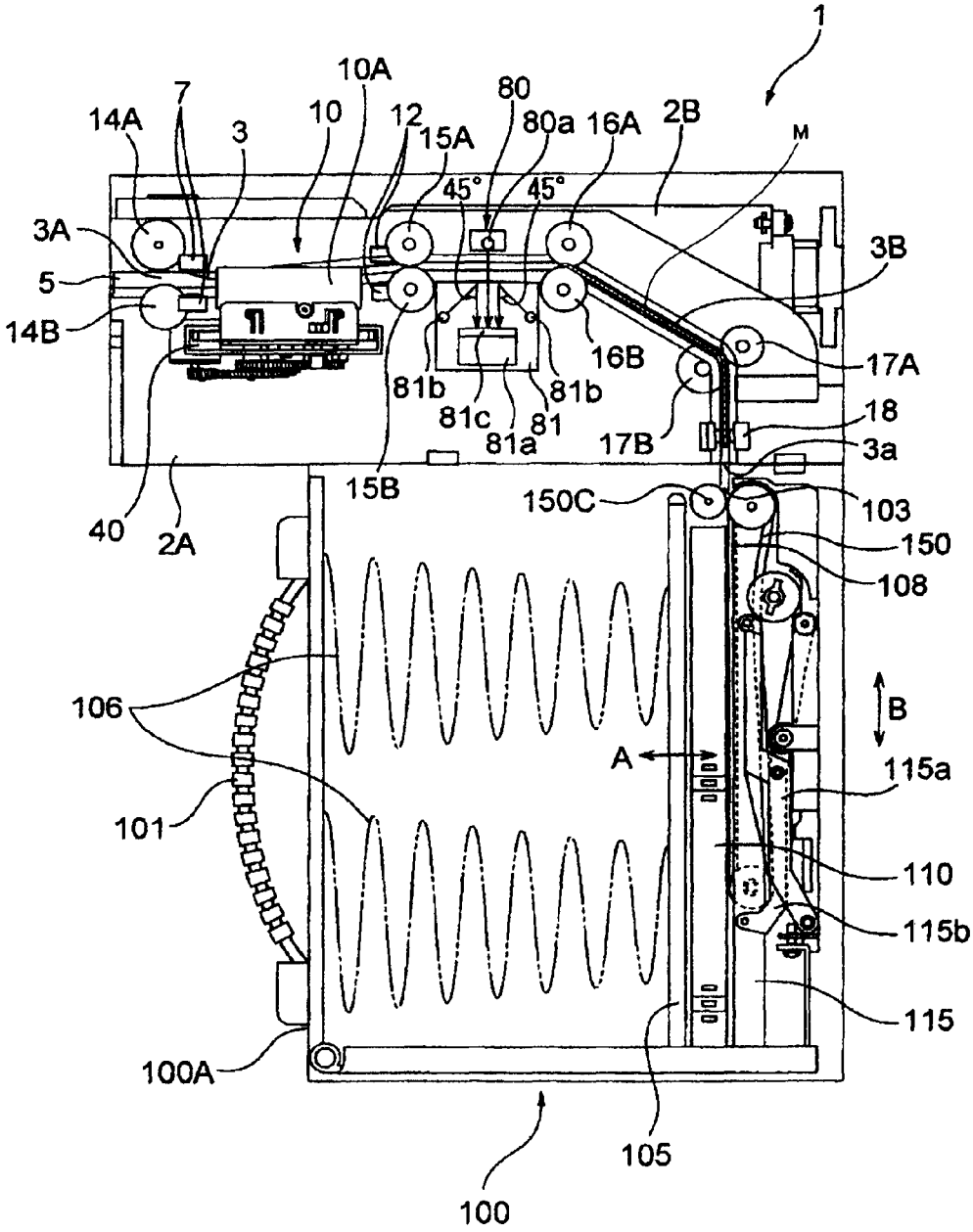
FIG. 14 is a right side view schematically showing a bill retained temporarily in the traveling route after reading of the bill.

FIG. 14 is a right side view of an apparatus of a different embodiment and schematically shows a state where a bill is conveyed as shown in the schematic diagram of FIG. 3. The basic configuration is the same as that shown in FIG. 3 such that different parts will be described hereafter. In FIG. 14, a bill M is temporarily retained on the downstream side of the bill reading means 8. That is, the bill M is conveyed into between the roller pairs 16A, 16B and 17A, 17B and while authenticity judgment is performed (ST18 to ST20), the conveyance mechanism stops and the bill M is retained (stopped) temporarily. At this time, the leading end portion of the bill M reaches the position where the bill can be detected by the discharge detecting sensor 18. As can be seen from the diagram, when the bill is judged to be a legitimate bill (ST 21, Yes) in the authenticity judgment (ST18), the discharge detecting sensor 18 detects the bill M (ST22, Yes) and the bill conveyor motor 13 is driven to normally rotate to convey the bill toward the bill housing part 100 (ST25).

Figure 15:
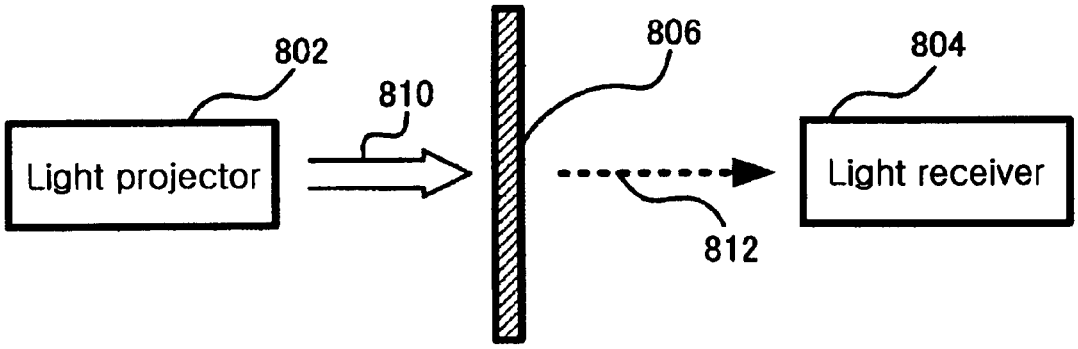
FIG. 15 is a diagram illustrating a principle mechanism of a transmission type photo sensor.
Figure 16:
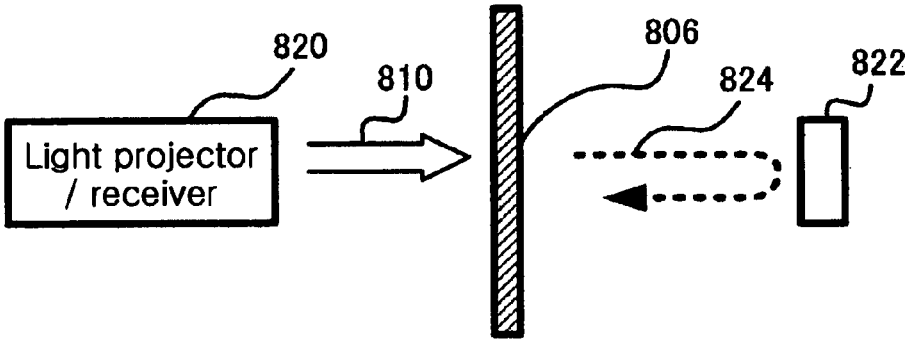
FIG. 16 is a diagram illustrating a principle mechanism of a regression and reflection type photo sensor.
Figure 17:
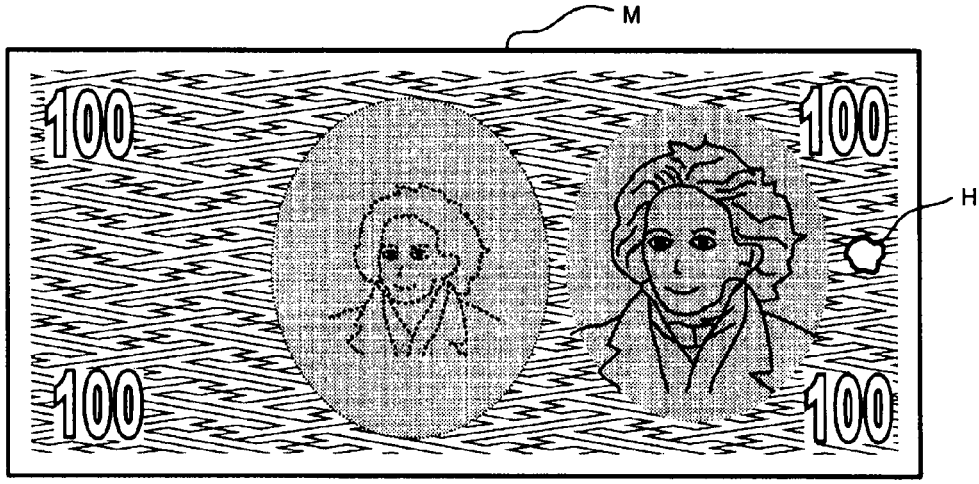
FIG. 17 is a schematic plan view showing a bill which includes a hole.

FIGS. 15 and 16 graphically show a specific example of a sensor that can be used as the discharge detecting sensor 18. FIG. 15 schematically shows a transmission type photo sensor and FIG. 16 schematically shows a regression and reflection type photo sensor. In the transmission type photo sensor, a light projector 802 and a light receiver 804 are arranged in opposition to each other and light 810 emitted from the light projector 802 is cut off by an object to be detected 806 located in between and light 812 that should be incident on the light receiver 804 cannot reach, and therefore, the presence of the object to be detected 806 is detected. In the regression and reflection type photo sensor, a light projector/receiver 820 and a reflecting plate 822 are arranged in opposition to each other and the light 810 emitted from the light projector/receiver 820 is cut off by the object to be detected 806 located in between and does not reach the reflecting plate 820. Hence, light 824 that is incident on the reflecting plate 822 and is reflected therefrom does not enter the light projector/receiver 820, and therefore, the presence of the object to be detected 806 is detected. However, in either case, if the object to be detected 806 is transparent, the object cannot be detected. FIG. 17 shows a schematic plan view of the bill M including a hole H. The position of the hole H is not in the region by which a bill is identified, and therefore, the authenticity judgment is not affected.

Such a paper sheet processing apparatus can comprise a traveling route that extends from an insertion slot through which a paper sheet can be inserted to a discharge slot through which the paper sheet can be discharged, a conveyance mechanism that can drive the inserted paper sheet to be conveyed in the traveling direction toward the discharge slot in the traveling route, a reading unit being disposed in the traveling route and being capable of reading information of the paper sheet to be conveyed, a sensor being disposed on the downstream side of the reading unit in the traveling direction and being capable of detecting whether or not the paper sheet exists, an authenticity judging part being capable of judging the authenticity of the paper sheet conveyed in the traveling route based on the data read by the reading unit, and a controller that controls the conveyance mechanism so that the paper sheet to be conveyed stops temporarily on the downstream side of the reading unit, receives information from the sensor that detects whether or not the paper sheet exists when the paper sheet is judged to be a legitimate one by the authenticity judging part, controls the conveyance mechanism so that the conveyance mechanism drives the paper sheet to move in the traveling direction for a predetermined amount when not receiving information about the detection of the presence of the paper sheet, and receives information from the sensor that detects again whether or not the paper sheet exists. Here, the information from the sensor that detects whether or not a paper sheet exists may be a signal to notify that the presence of a paper sheet is detected or a signal to notify that the presence is not detected. Further, such information may include blank information that transmits no signal (no signal is sent for a predetermined period of time).

It is possible to provide the above-described paper sheet processing apparatus in which the controller controls the conveyance mechanism so that the conveyance mechanism drives the paper sheet to be conveyed in the backward direction toward the insertion slot when not receiving the information of detecting the presence of the paper sheet in the redetection. Here, the traveling direction may mean the direction in which the paper sheet including a bill is conveyed from the insertion slot to the discharge slot. The backward direction may mean the opposite direction. That is, if the paper sheet is conveyed in the backward direction, the paper sheet is finally pushed out to the operator through the insertion slot. Further, it is possible to provide the above-described paper sheet processing apparatus in which a shutter member is disposed between the reading unit and the sensor in the traveling route and a distal end of the paper sheet temporarily stopped on the downstream side of the reading unit at the time of the judgment by the authenticity judging part is located on the upstream side of the shutter member.

Furthermore, a method, which is another embodiment, of conveying a paper sheet in a traveling direction toward a discharge slot by driving of a conveyance mechanism along the traveling route that extends from an insertion slot to the discharge slot may include the following steps. Firstly, an acquiring step of acquiring data of the paper sheet by a reading unit that reads information of the paper sheet arranged on the way of the traveling route, while conveying the paper sheet in the traveling direction, is included, and next, a stopping step of temporarily stopping the paper sheet on the downstream side of the reading unit is included. Then, it is possible to provide the conveyance method including a judging step of judging the authenticity of the paper sheet based on the acquired data, a detecting step of causing a sensor disposed between the reading unit and the discharge slot in the traveling route to detect whether or not the paper sheet exists when the paper sheet is judged to be a legitimate one in the judging step, a predetermined-amount moving step of moving the paper sheet in the traveling direction for a predetermined amount by driving the conveyance mechanism when the paper sheet is not detected in the detecting step, and a redetecting step of causing the sensor to redetect whether or not the paper sheet exists. Further, it is possible to provide the above-described conveyance method including a step of driving the conveyance mechanism to convey the paper sheet in the backward direction toward the insertion slot when the paper sheet is not detected in the redetecting step.

In accordance with the present invention, a paper sheet processing apparatus may be provided such that the apparatus is capable of reliably detecting the bill in the bill traveling route.

As mentioned above, the embodiment of the present invention is described. However, the present invention is not limited to the above-described embodiments, and various modifications of the present invention can be implemented.

In the present invention, when the presence of a bill cannot be confirmed in a step of detecting whether the bill exists in the bill traveling route 3 by a sensor, the redetection process can be performed. Further, as to configurations other than that, the present invention is not limited to the above-mentioned embodiments. Therefore, the concrete identification method in an authenticity judgment process, the configuration of the bill reading means (which may have another configuration other than the line sensor), and the mechanisms for driving the various types of driving members may be appropriately modified.

Further, the detection sensor that detects the presence of the bill is arranged in a position that is not limited in particular. For example, in the above-mentioned embodiments, it may also be possible to perform a similar redetection process by utilizing an insertion detecting sensor 7 or a movable piece passage detecting sensor 12. In this case, the bill is conveyed for a predetermined amount toward the bill housing part side (downstream side), and alternatively, it may also be possible to convey the bill for a predetermined amount toward the bill insertion slot side (upstream side). The predetermined amount may be set to an amount suitable to confirm the processing of the bill by the redetection process. The predetermined amount may be determined appropriately in advance and may be set to a constant value, or a variable value. For example, it is possible to input the predetermined amount, in advance or at any time in accordance with a using condition thereof, to the controller as a value half or more, the same or more, or one and half or more than that of the estimated size of the transparent portion or hole (length in the traveling direction). The presumable size of the transparent portion or hole can be obtained from the design data of the bill or statistical data of the bill.

Further, the above-mentioned embodiments are configured such that the bill in a resting state is conveyed by driving the bill conveyance mechanism 6 whereby the presence of the bill can be detected again, and it is also possible to detect reliably the presence of the polymer bill or the bill having a damage by controlling the apparatus such that a detection signal of the sensor to notify the presence of the bill being moved in the bill traveling route 3 is redetected.

The present invention can be incorporated, for example, into various types of apparatuses to provide products and services by inserting a bill thereinto and into a device other than the paper sheet processing apparatus as described above to process various kinds of paper sheets such as a coupon ticket, a service certificate, and so on.

DESCRIPTION OF NOTATIONS

1 bill processing apparatus
2 apparatus main body
3 bill traveling route
5 bill insertion slot
6 bill conveyance mechanism
8 bill reading means
10 skew correction mechanism
80 light emitting unit
80*a* first light emitting part
81 light receiving/emitting unit
81*a* light receiving part
81*b* second light emitting part
200 control means

What is claimed is:

1. A paper sheet processing apparatus comprising:

a conveyance mechanism which is capable of driving a paper sheet to be conveyed along a traveling route;

an authenticity judging part which determines an authenticity of the paper sheet being conveyed in the traveling route;

a sensor which detects whether or not the paper sheet is present in the traveling route; and a controller which carries out a redetection process to detect whether or not the paper sheet is present in the traveling route by the sensor again after the conveyance mechanism is driven for a predetermined amount and stopped in a case of having not detected presence of the paper sheet upon previous detection of either presence or absence of the paper sheet by the sensor under a condition that driving of the conveyance mechanism of the traveling route is stopped after an authenticity determination by the authenticity judging part, wherein the controller controls the conveyance mechanism to convey the paper sheet in a returning direction.

2. A paper sheet processing apparatus comprising:

a traveling route extending from an insertion slot through which a paper sheet is capable of being inserted to a discharge slot from which the paper sheet is capable of being discharged;

a conveyance mechanism which is capable of driving the paper sheet having been inserted to be conveyed in a traveling direction toward the discharge slot in the traveling route;

a reading unit which is arranged on the traveling route and reads information of the paper sheet being conveyed;

a sensor which is capable of detecting whether or not the paper sheet is present, the sensor arranged on a downstream side of the reading unit in the traveling direction;

an authenticity judging part which is capable of determining an authenticity of the paper sheet being conveyed in the traveling route based on data having been read by the reading unit;

a controller which:

controls the conveyance mechanism such that the paper sheet being conveyed is stopped temporarily on a downstream side of the reading unit;

receives information from the sensor having detected whether or not the paper sheet is present when the authenticity judging part determines the paper sheet is legitimate;

controls the conveyance mechanism to drive the paper sheet for a predetermined amount in a traveling direction if information of having detected presence of the paper sheet is not received; and receives information from the sensor performing redetection of whether or not the paper sheet is present; and controls the conveyance mechanism to convey the paper sheet toward the insertion slot in a returning direction when information of having detected presence of the paper sheet in the redetection is not received.

3. The paper sheet processing apparatus according to claim 2, comprising:

a shutter member arranged between the reading unit and the sensor in the traveling route, wherein an end portion of the paper sheet stopped temporarily is on the downstream side of the reading unit when the authenticity is judged by the authenticity judging part.

4. A conveyance method of conveying a paper sheet in a direction toward a discharge slot by a conveyance mechanism along a traveling route extending from an insertion slot to the discharge slot, the method comprising the steps of:

acquiring data of the paper sheet via a reading unit which is arranged in a middle of the traveling route and reads information of the paper sheet as the paper sheet is conveyed in the traveling direction;

stopping temporarily the paper sheet on a downstream side of the reading unit;

determining an authenticity of the paper sheet based on the data having been acquired;

detecting whether or not the paper sheet is present by a sensor arranged between the reading unit and the discharge slot in the traveling route when the paper sheet is judged to be legitimate in the step of determining;

moving the paper sheet for a predetermined amount in the traveling direction by driving the conveyance mechanism if the paper sheet is not detected in the step of detecting;

allowing the sensor to redetect whether or not the paper sheet is present; and driving the conveyance mechanism to convey the paper sheet in a returning direction toward the insertion slot if the paper sheet is not detected in the step of allowing the sensor to redetect the paper sheet.

* * * * *